US011808514B2

(12) United States Patent
Harikrishnasamy et al.

(10) Patent No.: US 11,808,514 B2
(45) Date of Patent: Nov. 7, 2023

(54) VACUUM INSULATED STRUCTURE WITH SHEET METAL FEATURES TO CONTROL VACUUM BOW

(71) Applicant: WHIRLPOOL CORPORATION, Benton Harbor, MI (US)

(72) Inventors: Arunkumar Harikrishnasamy, Stevensville, MI (US); Sai B. Krishna, Pune (IN); Abhay Naik, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 18/114,517

(22) Filed: Feb. 27, 2023

(65) Prior Publication Data

US 2023/0204279 A1 Jun. 29, 2023

Related U.S. Application Data

(63) Continuation of application No. 17/136,147, filed on Dec. 29, 2020, now Pat. No. 11,614,271.

(51) Int. Cl.
*F25D 23/06* (2006.01)
*F25D 11/02* (2006.01)

(52) U.S. Cl.
CPC ..... *F25D 23/062* (2013.01); *F25D 11/02* (2013.01); *F25D 2201/122* (2013.01); *F25D 2201/124* (2013.01); *F25D 2201/14* (2013.01)

(58) Field of Classification Search
CPC .. F25D 23/062; F25D 11/02; F25D 2201/122; F25D 2201/124; F25D 2201/14
See application file for complete search history.

(56) References Cited

U.S. PATENT DOCUMENTS

| | | | |
|---|---|---|---|
| 4,536,990 | A | 8/1985 | Siegrist et al. |
| 5,509,248 | A | 4/1996 | Dellby |
| 6,230,500 | B1 | 5/2001 | Mao et al. |
| 8,944,541 | B2 | 2/2015 | Allard et al. |
| 9,574,819 | B2 | 2/2017 | Kang et al. |
| 10,337,788 | B2 | 7/2019 | Jung et al. |
| 10,385,610 | B2 | 8/2019 | Artwohl et al. |
| 10,619,912 | B2 | 4/2020 | Liu et al. |

(Continued)

FOREIGN PATENT DOCUMENTS

| | | | |
|---|---|---|---|
| CN | 103968196 | B | 10/2017 |
| DE | 956899 | C | 1/1957 |

(Continued)

*Primary Examiner* — Hanh V Tran
(74) *Attorney, Agent, or Firm* — Price Heneveld LLP

(57) ABSTRACT

A refrigerator includes a vacuum-insulated cabinet structure enclosing an insulating cavity and including an outer wrapper having a first side wall defining a perimeter, an outer frame portion defined radially inward of the perimeter, and an inner area surrounded and supported by the outer frame portion. The inner area initially defines a first planar level with at least a portion of the outer frame portion extending to a second planar level parallel to and spaced apart from the first planar level in an axially outward direction. The insulating cavity is sealed and has a vacuum drawn therefrom with the outer frame portion deformed such that the inner area is moved axially inward away from the second planar level under a force of the vacuum within the insulating cavity with at least the portion of the outer frame portion remaining at the second planar level.

20 Claims, 16 Drawing Sheets

(56) References Cited

U.S. PATENT DOCUMENTS

| | | | |
|---|---|---|---|
| 10,697,696 | B1 | 6/2020 | Ekshinge et al. |
| 10,697,698 | B2 | 6/2020 | Dherde et al. |
| 11,300,238 | B2 | 4/2022 | Allard et al. |
| 2013/0256319 | A1 | 10/2013 | Kuehl et al. |
| 2014/0360603 | A1 | 12/2014 | Godbole |
| 2016/0258671 | A1 | 9/2016 | Allard et al. |
| 2017/0190081 | A1 | 7/2017 | Naik et al. |
| 2018/0003427 | A1 | 1/2018 | Godbole |
| 2019/0128594 | A1 | 5/2019 | Allard et al. |
| 2019/0184624 | A1 | 6/2019 | Dherde |
| 2019/0264859 | A1 | 8/2019 | Dherde |
| 2019/0285336 | A1 | 9/2019 | Naik et al. |
| 2019/0293339 | A1 | 9/2019 | Gomes et al. |
| 2019/0308393 | A1 | 10/2019 | Allard et al. |
| 2020/0103067 | A1 | 4/2020 | Allard et al. |
| 2020/0370702 | A1 | 11/2020 | Harikrishnasamy et al. |

FOREIGN PATENT DOCUMENTS

| | | | |
|---|---|---|---|
| GB | 760338 | | 10/1953 |
| JP | 4580843 | B2 | 11/2010 |
| JP | 2013088036 | A | 5/2013 |
| JP | 2015038374 | A | 2/2015 |
| JP | 5689387 | B2 | 3/2015 |
| KR | 100541061 | B1 | 1/2006 |
| KR | 20190092602 | A | 8/2019 |
| TW | 1494530 | B | 8/2015 |
| WO | 2018063275 | A1 | 4/2018 |
| WO | 2018099464 | A1 | 6/2018 |
| WO | 2018118080 | A1 | 6/2018 |
| WO | 2020158012 | A1 | 8/2020 |

VACUUM INSULATED STRUCTURE WITH SHEET METAL FEATURES TO CONTROL VACUUM BOW

CROSS-REFERENCE TO RELATED APPLICATIONS

The present application is a Continuation of U.S. patent application Ser. No. 17/136,147, which was filed on Dec. 29, 2020, now U.S. Pat. No. 11,614,271, which is entitled "VACCUM INSULATED STRUCTURE WITH SHEET METAL FEATURES TO CONTROL VACCUM BOW," the entire disclosure of which is incorporated herein by reference.

BACKGROUND OF THE DISCLOSURE

The present disclosure generally relates to a vacuum insulated structure for a refrigerator, and more specifically, to cover member geometry for controlling the effects of vacuum evacuation on the structure.

SUMMARY OF THE DISCLOSURE

According to one aspect of the present disclosure, a vacuum insulated structure includes a first cover member of a unitary sheet member defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axial direction. The vacuum insulated structure further includes a second cover member of a unitary sheet and a thermal bridge interconnecting the first cover member and the second cover member at the perimeter portions thereof to define an insulating cavity therebetween. The insulating cavity is a sealed cavity having a vacuum drawn therefrom, and the outer frame portion deforms such that the inner area moves axially inward away from the second planar level under a force of the vacuum within the insulating cavity.

According to another aspect of the present disclosure, a method of making a vacuum insulated cabinet structure includes assembling first and second cover members with a thermal bridge, at least the first cover member defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axially outward direction. Assembling the first and second cover members with the thermal bridge defines a sealed insulating cavity therebetween. The method further includes drawing a vacuum from the sealed insulating cavity that causes the outer frame portion to deform such that the inner area moves axially inward from the second planar level under a force of the vacuum within the insulating cavity.

According to another aspect of the present disclosure, a refrigerator includes a vacuum-insulated cabinet structure having an outer wrapper with a first side defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axially outward direction. The refrigerator further includes an inner liner disposed inward of the outer wrapper and a thermal bridge interconnecting the first cover member and the second cover member at the perimeter portions thereof to define an insulating cavity therebetween. The insulating cavity is a sealed cavity having a vacuum drawn therefrom, and the outer frame portion deforms such that the inner area moves axially inward away from the second planar level under a force of the vacuum within the insulating cavity.

According to another aspect of the present disclosure, a refrigerator includes a vacuum-insulated cabinet structure enclosing an insulating cavity and including an outer wrapper having a first side wall defining a perimeter, an outer frame portion defined radially inward of the perimeter, and an inner area surrounded and supported by the outer frame portion. The inner area initially defines a first planar level with at least a portion of the outer frame portion extending to a second planar level parallel to and spaced apart from the first planar level in an axially outward direction. The insulating cavity is sealed and has a vacuum drawn therefrom with the outer frame portion deformed such that the inner area is moved axially inward away from the second planar level under a force of the vacuum within the insulating cavity with at least the portion of the outer frame portion remaining at the second planar level.

According to another aspect of the present disclosure, a refrigerator includes a cabinet enclosing an insulating cavity and has an outer wrapper with a first side wall defining a perimeter, an outer frame portion defined radially inward of the perimeter, and an inner area surrounded and supported by the outer frame portion. The inner area initially defines a first planar level with at least a portion of the outer frame portion extending to a second planar level parallel to and spaced apart from the first planar level in an axially outward direction. The insulating cavity is sealed and has a vacuum drawn therefrom with the outer frame portion deformed such that the inner area is moved axially inward away from the second planar level under a force of the vacuum within the insulating cavity with at least the portion of the outer frame portion remaining at the second planar level. A first inner liner is disposed inward of the outer wrapper and defines a first inner cavity having a first opening, and a thermal bridge interconnects the outer wrapper and the first inner liner around the first opening. The refrigerator further includes a first door closeable over at least a portion of the first opening.

According to another aspect of the present disclosure, a method of making refrigerator includes sealing an outer wrapper having a first side wall to a first inner liner to define a vacuum-insulated cabinet structure enclosing an insulating cavity and including an outer wrapper. The first side wall defines a perimeter, an outer frame portion defined radially inward of the perimeter, and an inner area surrounded and supported by the outer frame portion. The inner area initially defines a first planar level with at least a portion of the outer frame portion extending to a second planar level parallel to and spaced apart from the first planar level in an axially outward direction. The method further includes drawing a vacuum from the insulating cavity such that the outer frame portion deforms by movement of the inner area axially inward away from the second planar level with at least the portion of the outer frame portion remaining at the second planar level.

These and other features, advantages, and objects of the present disclosure will be further understood and appreciated by those skilled in the art by reference to the following specification, claims, and appended drawings.

Figure 1A:
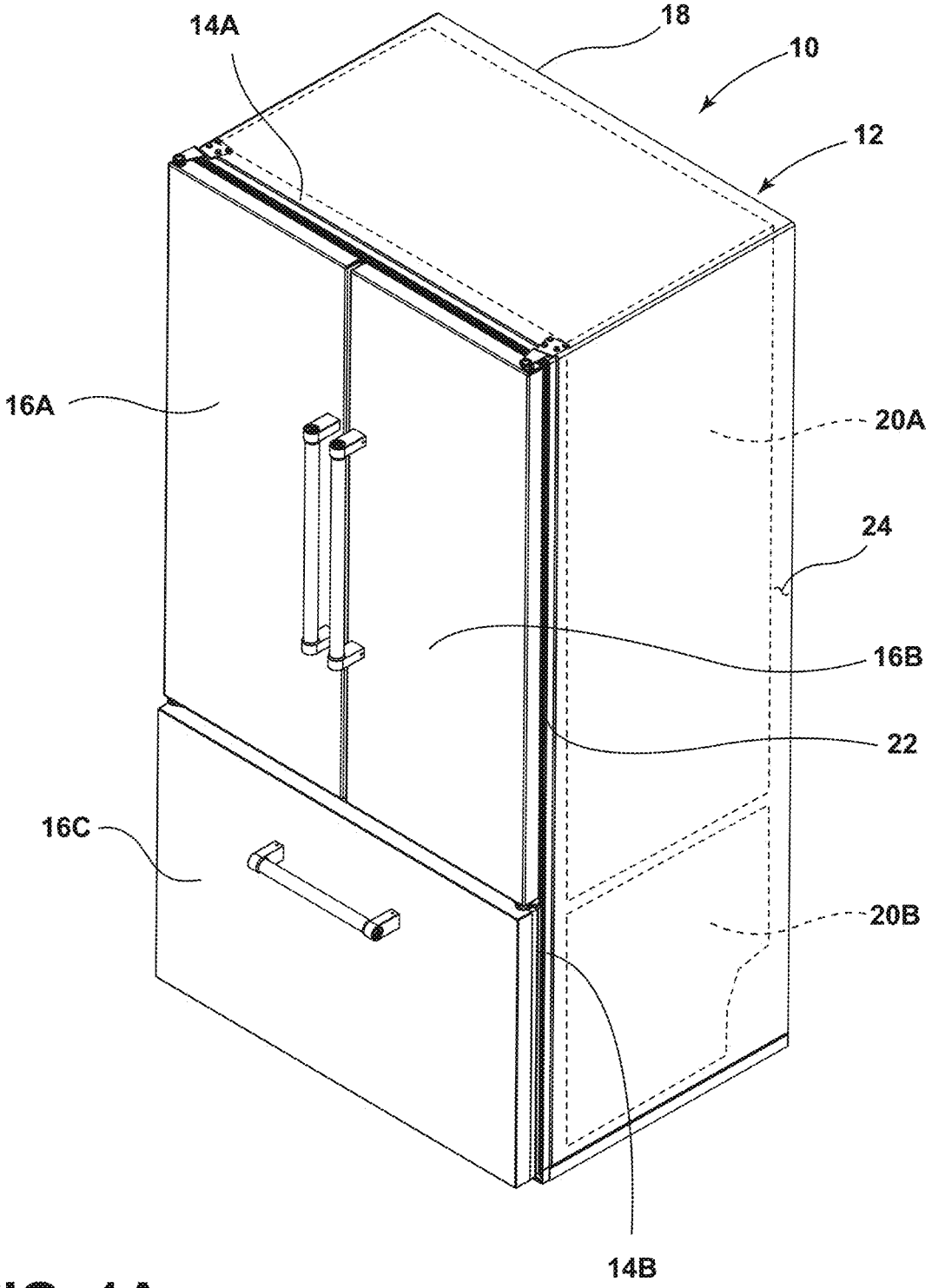
FIG. 1A is a isometric view of a refrigerator including a vacuum insulated cabinet structure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum insulated structure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 1B:
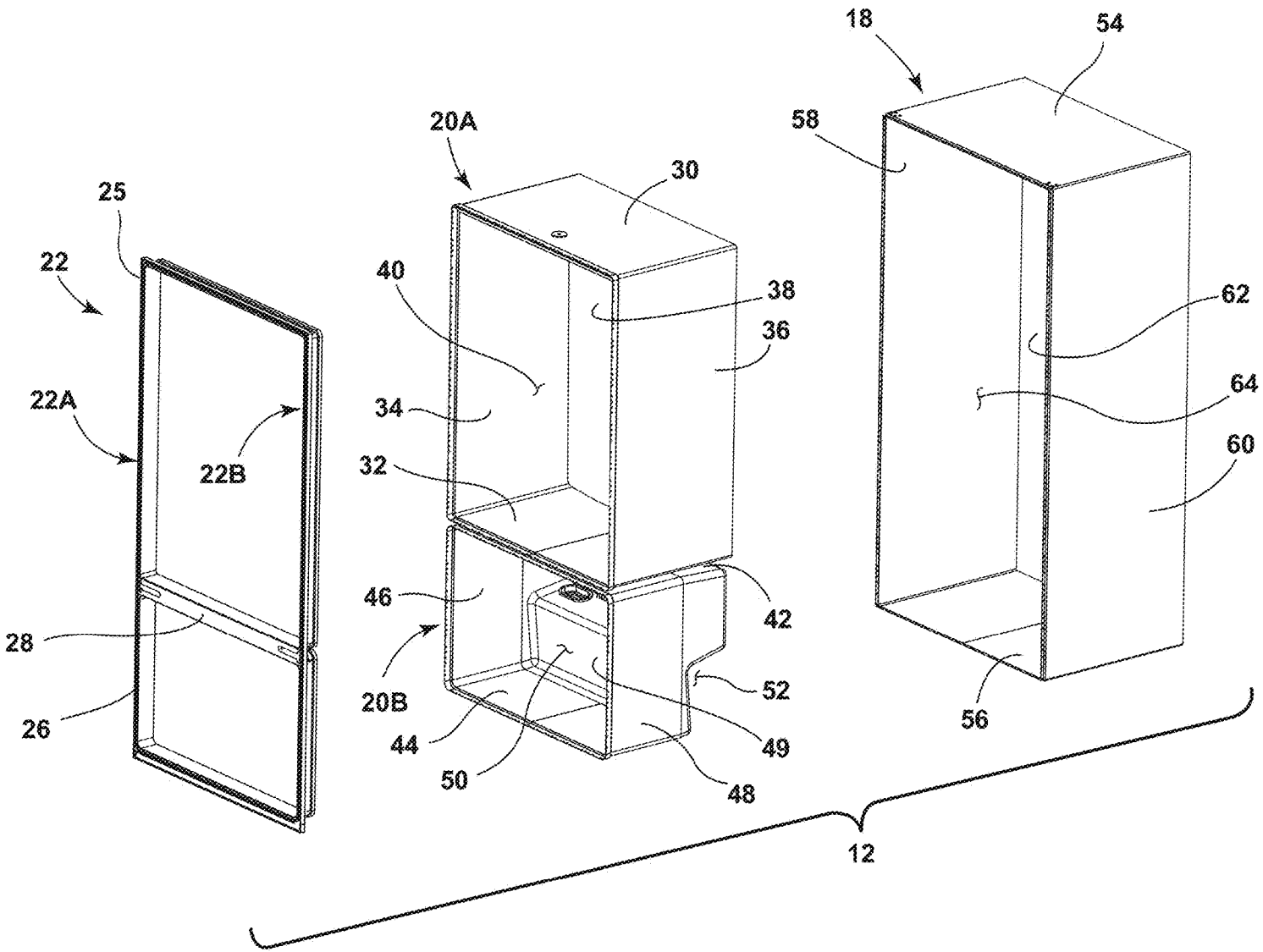
FIG. 1B is an exploded perspective view of another vacuum insulated cabinet structure.

Referring to FIGS. 1A-8, reference numeral 12 generally designates a vacuum insulated structure for an appliance such as the refrigerator 10 illustrated in FIGS. 1A and 1B. The vacuum insulated structure 12 includes a first cover member of a unitary sheet member defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axial direction. The vacuum insulated structure further includes a second cover member of a unitary sheet and a thermal bridge interconnecting the first cover member and the second cover member at the perimeter portions thereof to define an insulating cavity therebetween. The insulating cavity is a sealed cavity having a vacuum drawn therefrom, and the outer frame portion deforms such that the inner area moves axially inward away from the second planar level under a force of the vacuum within the insulating cavity.

Referring now to FIG. 1A, a refrigerator 10 is shown having a vacuum insulated cabinet structure 12. The vacuum insulated cabinet structure 12 includes one or more front openings 14A, 14B that may be closed off by doors 16A, 16B and 16C. The doors 16A, 16B are contemplated to pivot between open and closed positions relative to upper front opening 14A. As further found in the illustrated example, door 16C is in the form of a sliding drawer which horizontally slides between open and closed positions for selectively providing access to the lower front opening 14B of the insulated cabinet structure 12.

As further shown in FIG. 1A, the vacuum insulated cabinet structure 12 includes an exterior wrapper 18 and upper and lower liners 20A, 20B. In the embodiment shown in FIG. 1A, the upper and lower liners 20A, 20B generally indicate a refrigerator compartment and a freezer compartment, respectively. In assembly, the upper and lower liners 20A, 20B are interconnected with the exterior wrapper 18 via a thermal bridge 22. The thermal bridge 22 is best shown in FIG. 1B. As further shown in FIG. 1A, the exterior wrapper 18 is spaced-apart from the upper and lower liners 20A, 20B to define an insulating cavity 24 therebetween. The insulating cavity 24 is contemplated to be a sealed cavity that may comprise a vacuum core material such as a silica powder or other suitable loose filler material that is inserted (e.g., blown) into the insulating cavity 24 after the exterior wrapper 18, upper and lower liners 20A, 20B and thermal bridge 22 have been coupled together.

Referring now to FIG. 1B, the vacuum insulated cabinet structure 12 is shown in an exploded view. The thermal bridge 22 of the vacuum insulated cabinet structure 12 includes first and second side members 22A and 22B along with upper and lower openings 25, 26 which are configured to align with the upper and lower liners 20A, 20B in assembly. The thermal bridge 22 further includes a mullion portion 28 disposed between the upper and lower openings 25, 26 and extending between the first and second side members 22A, 22B. The upper liner 20A is shown having a top wall 30, a bottom wall 32, opposed side walls 34, 36 and a rear wall 38 (collectively referred to herein as sidewalls) which all cooperate to define a refrigerator compartment 40. Similarly, the lower liner 20B includes a top wall 42, a bottom wall 44, interconnecting sidewalls 46, 48 and a rear wall 49 which all cooperate to define a freezer compartment 50. The rear wall 49 is shown having a stepped configuration to define a spacing 52 which may be used to house various cooling components for cooling both the refrigerator compartment 40 and the freezer compartment 50. The upper and lower liners 20A, 20B may be comprised of a sheet metal material that is folded and welded to define the parameters of the refrigerator compartment 40 and the freezer compartment 50.

As further shown in FIG. 1B, the exterior wrapper 18 includes a top wall 54, a bottom wall 56, opposed sidewalls 58, 60 and a rear wall 62 (collectively referred to herein as sidewalls) which together cooperate to define a receiving cavity 64. The exterior wrapper 18 may be comprised of a sheet metal material that is folded and/or welded to define the parameters of the receiving cavity 64 such that the wrapper 18 is generally of a unitary structure. In assembly, the upper and lower liners 20A, 20B are received in the receiving cavity 64 of the exterior wrapper 18, such that the exterior surfaces of the upper and lower liners 20A, 20B cooperate with the inner surfaces of the exterior wrapper 18 to define the insulating cavity 24 disposed therebetween as shown in FIG. 1A. The insulating cavity 24 may directly receive an insulating material and have a vacuum drawn directly from the insulating cavity 24 to provide a vacuum insulating cabinet structure 12. In this way, the vacuum insulated cabinet structure 12 may include an overall thinner profile to maximize the amount of space available for the refrigerator compartment 40 and the freezer compartment 50 in assembly.

Figure 2A:
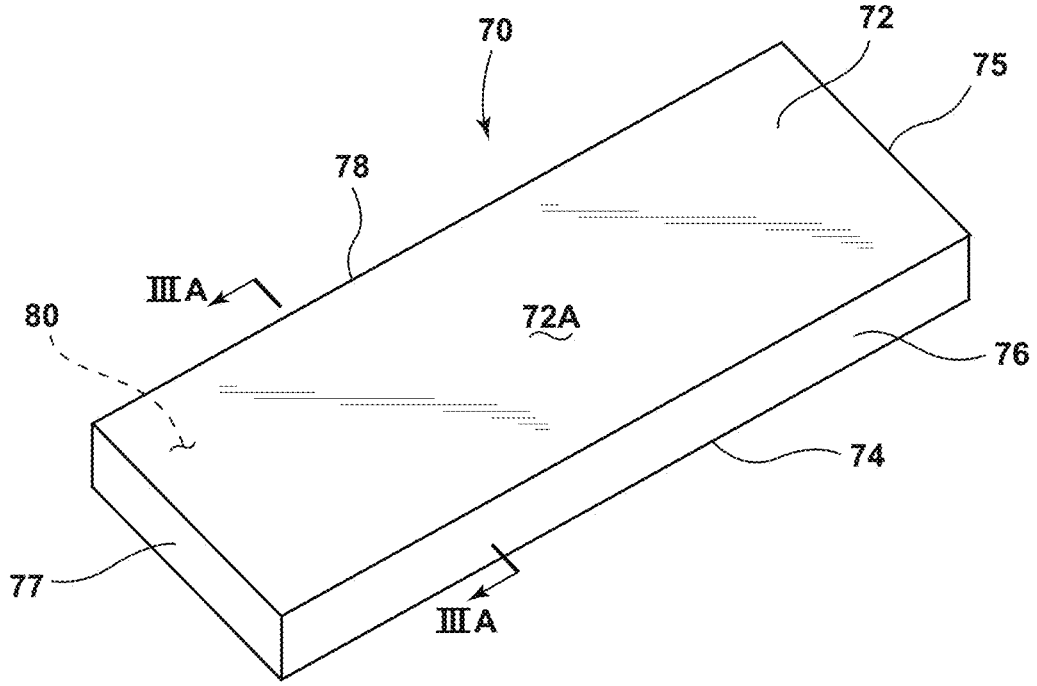
FIG. 2A is a top perspective view of a schematic vacuum insulated cabinet structure prior to a vacuum drawing procedure.

Referring now to FIG. 2A, a schematic assembly 70 is used to describe a deformation effect of a vacuum drawing procedure. The assembly 70 includes first and second cover members 72, 74 that are spaced-apart from one another and interconnected by side members 75-78. The side members 75-78 may be side members of a unitary frame structure to which the first and second cover members 72, 74 are attached. The assembly 70 includes a cavity 80 defined by the first and second cover members 72, 74 as spaced-apart from one another and interconnected by side members 75-78. The cavity 80 may be filled with a particulate material, such as a compressed cake of activated carbon black or silica gel, or a mixture of the two. These fillers are designed to fill the cavity 80 and are placed therein before a vacuum is drawn on the assembly 70. The filler is indicated by reference numeral 82 and is best shown in FIG. 3A.

Figure 2B:
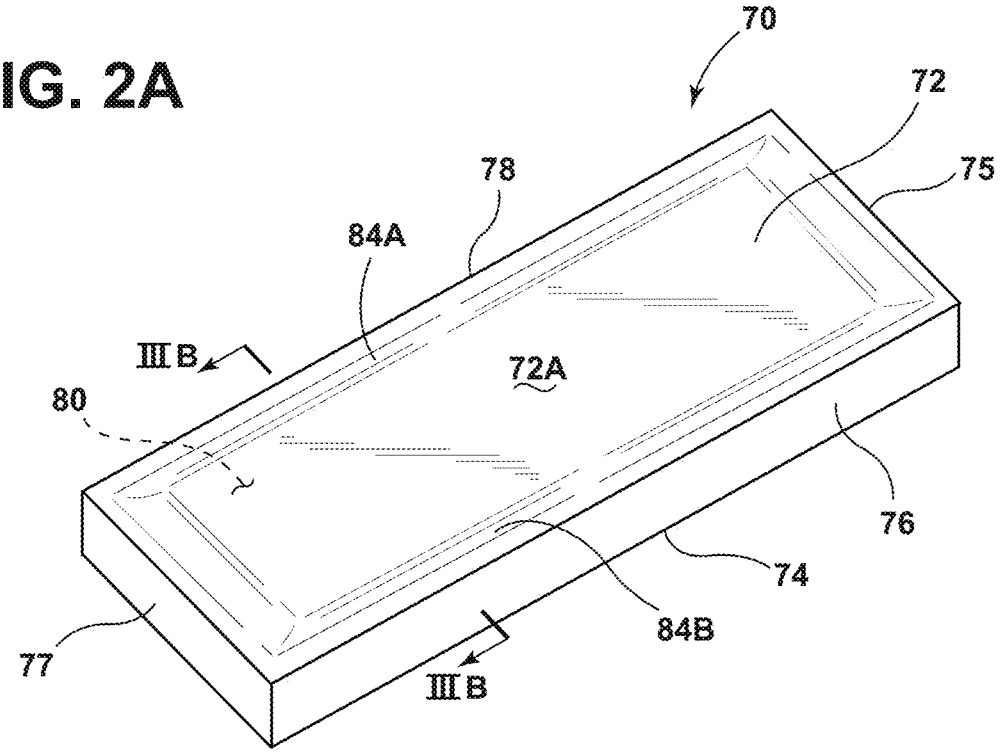
FIG. 2B is a top perspective view of the schematic vacuum insulated cabinet structure of FIG. 2A after a vacuum has been drawn.

Referring now to FIG. 2B, the schematic assembly 70 has had a vacuum drawn on the cavity 80, such that the cavity 80 now defines an evacuated cavity 80. By drawing the vacuum on the schematic assembly 70, the first and second cover members 72, 74 have inwardly collapsed towards each other, thereby providing for a deformed outer surface 72A of first cover member 72 as shown in FIG. 2B. The deformation of the schematic assembly 70 shown in FIG. 2B is best depicted in FIG. 3B.

Figure 3A:
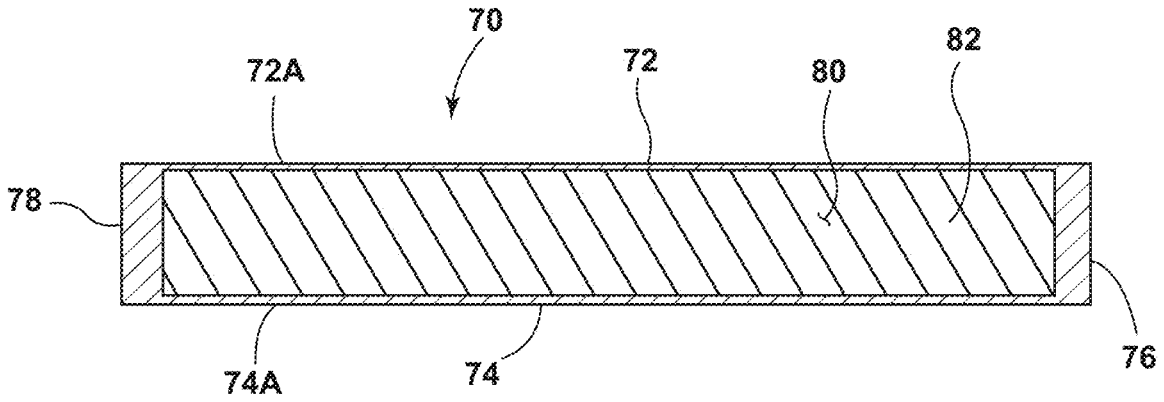
FIG. 3A is a cross-sectional view of the schematic vacuum insulated cabinet structure of FIG. 2A taken at line IIIA.
Figure 3B:
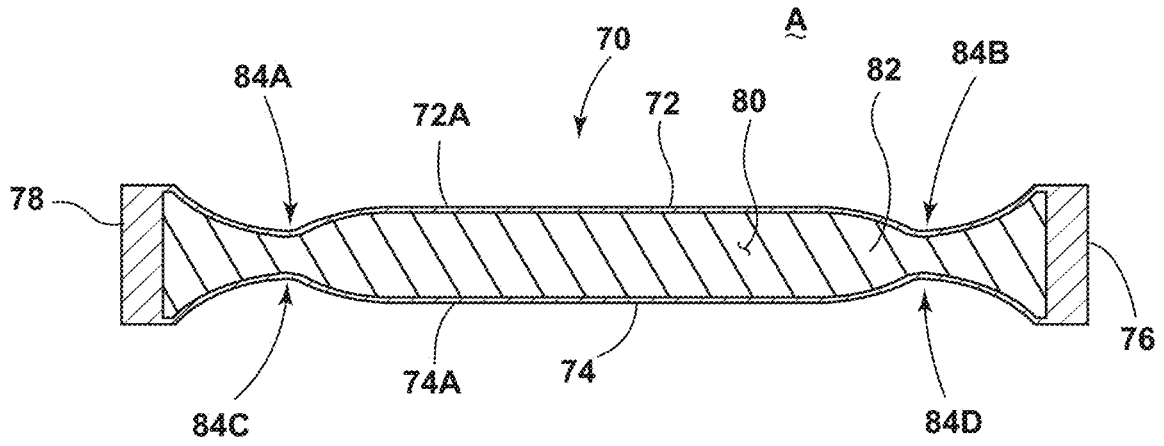
FIG. 3B is a cross-sectional view of the schematic vacuum insulated cabinet structure of FIG. 2B taken at line IIIB.

Referring now to FIG. 3A, the cross-sectional view of the schematic assembly 70 shown in FIG. 2A is depicted, wherein the outer surface 72A of the first cover member 72 and an outer surface 74A of the second cover member 74 are shown in substantially planar configurations between side members 78, 76. This configuration shown in FIG. 3A is an ideal configuration for a vacuum insulated structure after a vacuum has been drawn on the schematic assembly 70. However, as noted above, when a vacuum is drawn on the schematic assembly 70 of FIGS. 2A and 3A, a deformed schematic assembly 70, as shown in FIGS. 2B and 3B, is often the result. With specific reference to FIG. 3B, the outer surfaces 72A, 74A of the first and second cover members 72, 74 are no longer planar outer surfaces, but rather inwardly deformed outer surfaces having specific indent deformations 84A-84D which draw the first and second cover members 72, 74 towards one another due to the low pressure of the evacuated cavity 80. The pressure within the evacuated cavity of panel 70 is contemplated to be less than 10 mbar as compared to an atmospheric pressure of 1 atm or 1013.25 mbar.

Figure 21A:
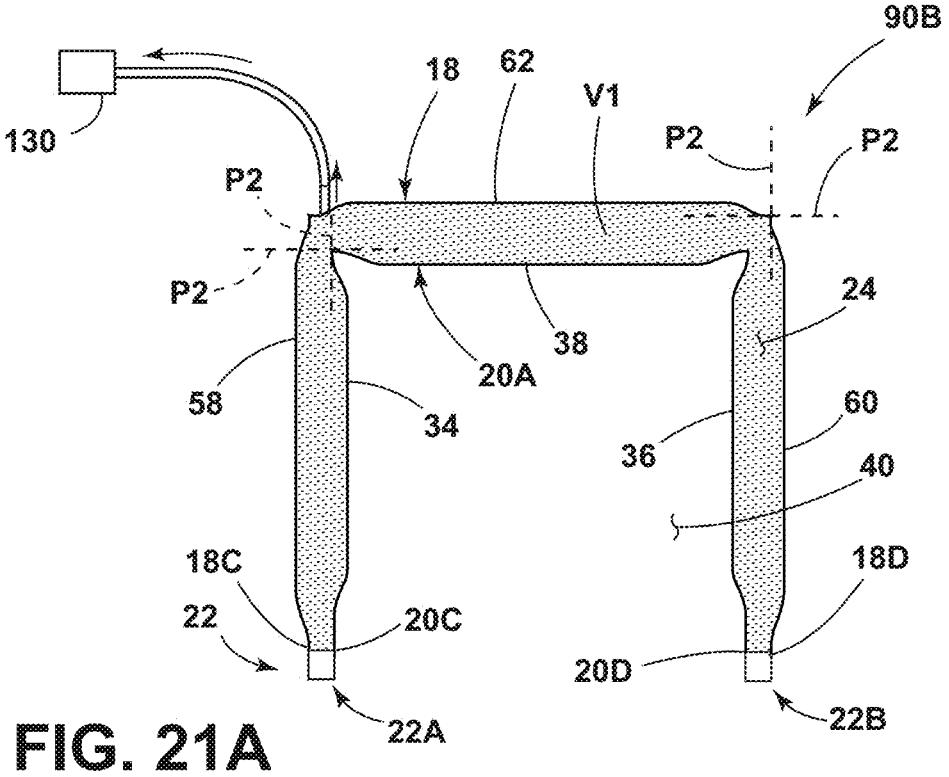
FIG. 21A is a cross-sectional view of a vacuum insulated structure according to another aspect of the disclosure.
Figure 21B:
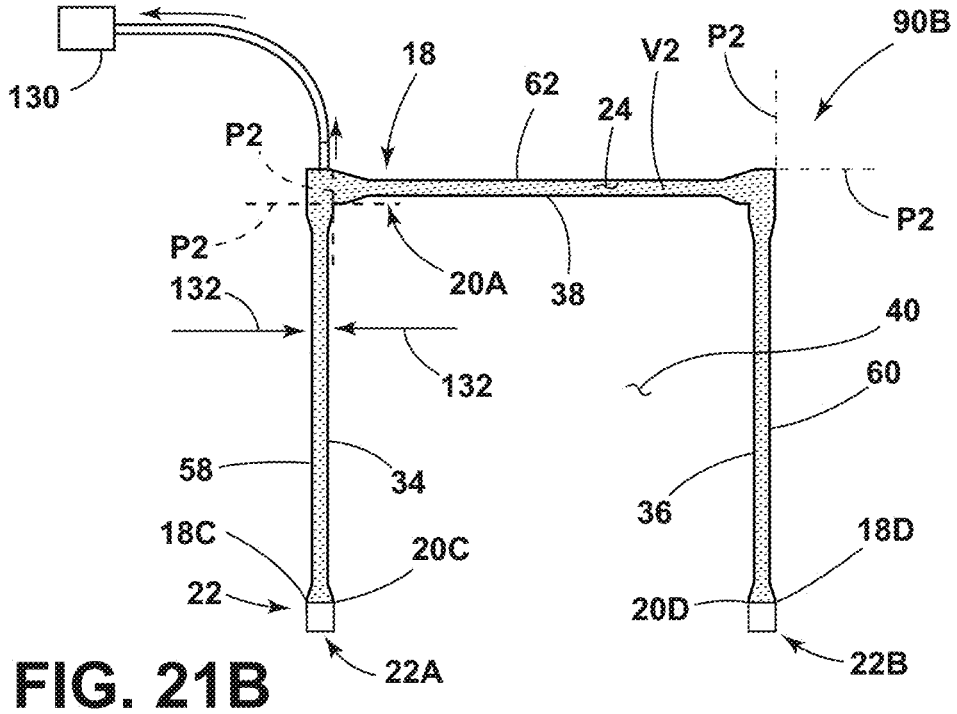
FIG. 21B is a cross-sectional view of the vacuum insulated structure of FIG. 21A after a vacuum has been drawn on the structure.

In an effort to avoid the vacuum deformation bow shown in the schematic assembly 70 of FIGS. 2A-3B, the present concept includes a vacuum insulated structure having an area configured for controlled deformation, as further described below. Specifically, in the embodiment shown in FIGS. 4-8, a simplified version of a vacuum insulated structure 90 is shown, wherein it is contemplated that the vacuum insulated structure 90 may represent a controlled deformation technique as applied to an entire vacuum insulated structure, such as the vacuum insulated cabinet structure 12 of FIGS. 1A and 1B at the insulating cavity 24. As such, it is contemplated that the vacuum insulated structure 90 illustrates an exemplary structure having a controlled deformation technique used to provide a substantially planar structure after a vacuum has been drawn therefrom. The configuration of the vacuum insulated structure 90 is not meant to limit the scope of the present concept in any manner. Further, as shown in FIGS. 21A and 21B, the pre-deformation technique may apply to a vacuum insulated structure 90B which specifically relates to the structure of a refrigerator cabinet. Thus, the vacuum insulated structure 90 shown in FIGS. 2A-3B may represent a single sidewall of a vacuum insulated cabinet structure 90B shown in FIGS. 21A and 21B or opposing outer sides 92A and 92B of the cabinet structure 90B.

Figure 4:
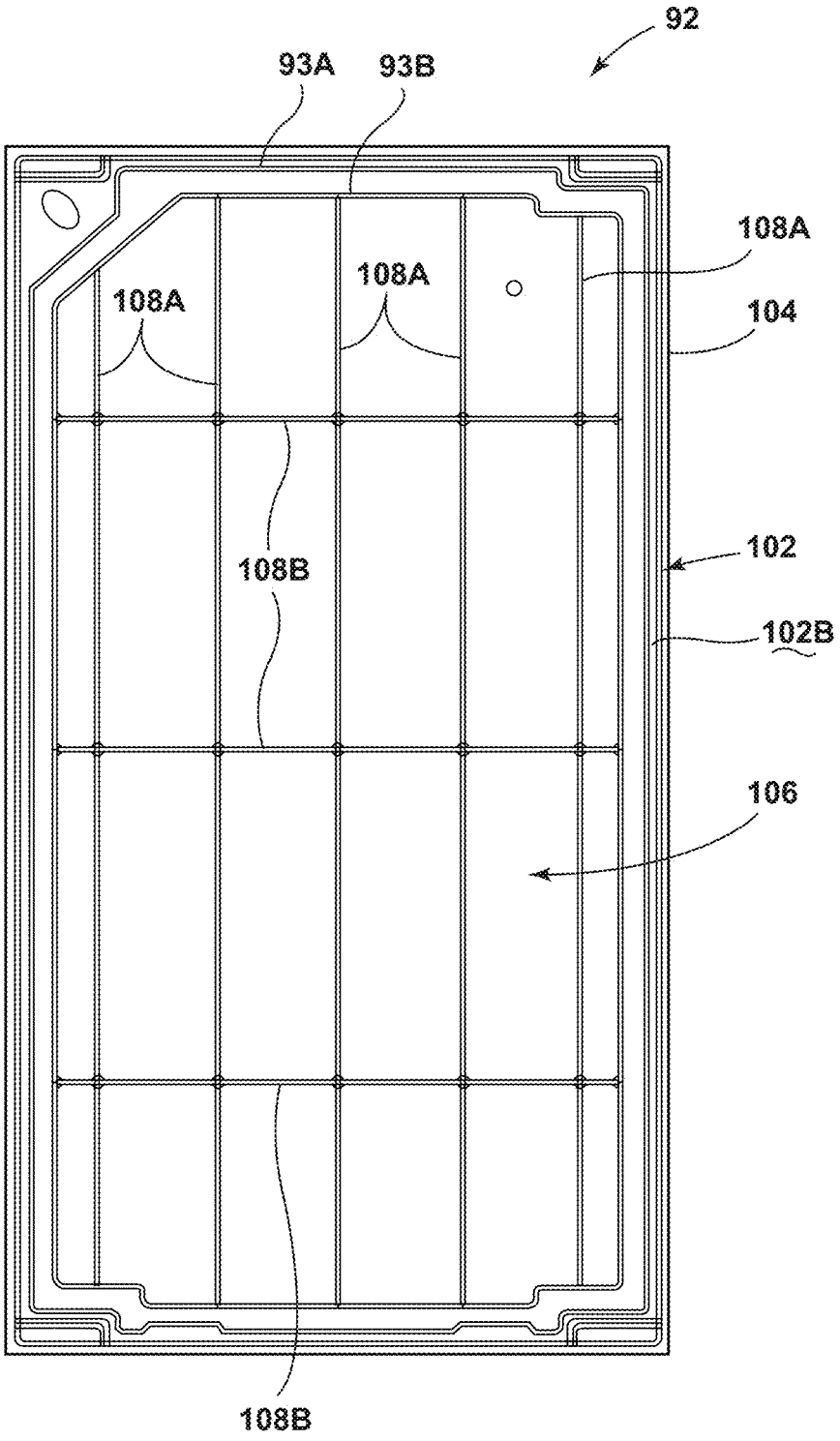
FIG. 4 is a side plan view of a cover member useable in connection with a vacuum insulated structure to control deformation due to vacuum draw, according to an aspect of the present disclosure.
Figure 5:
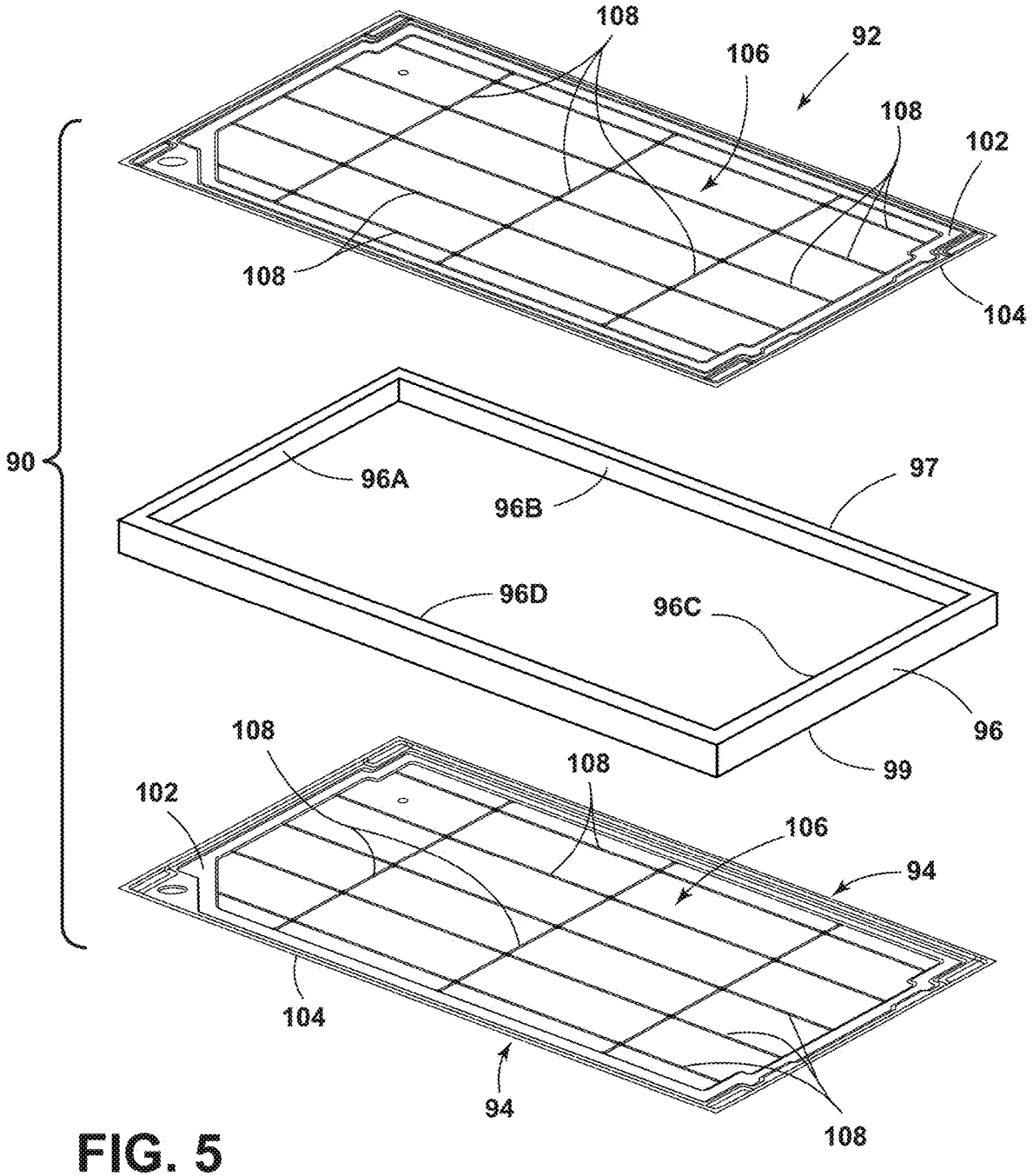
FIG. 5 is a an exploded top perspective view of a schematic vacuum insulated cabinet structure including the cover member of FIG. 4.
Figure 6:
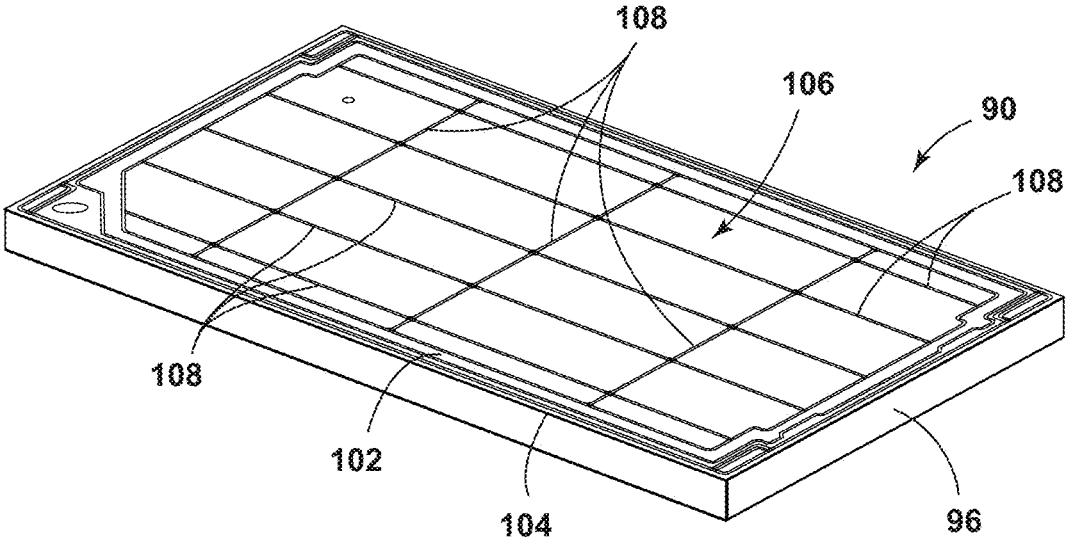
FIG. 6 is a top perspective view of the schematic vacuum insulated cabinet structure of FIG. 5 in an assembled condition and prior to a vacuum being drawn.
Figure 7:
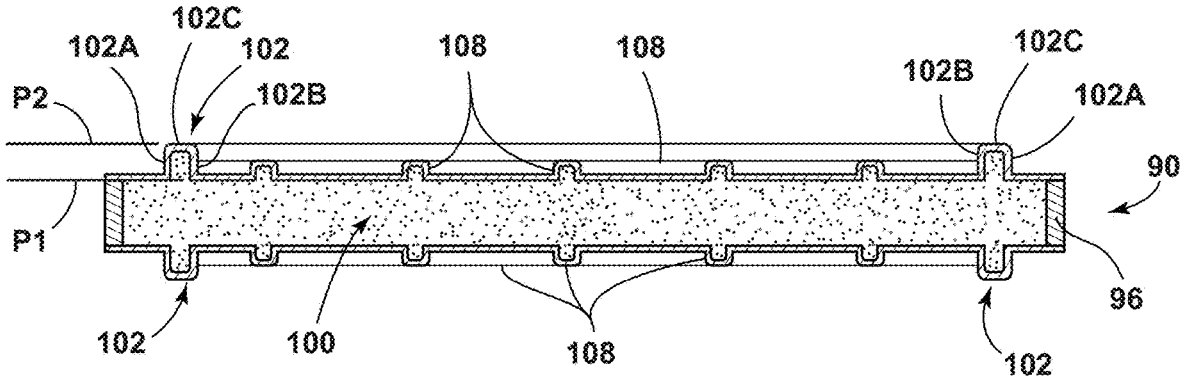
FIG. 7 is a cross-sectional view of the sidewall of the vacuum insulated cabinet structure of FIG. 6 taken at line VII-VII in FIG. 6.

Thus, in accordance with the present concept, a vacuum insulated structure 90 is shown in FIGS. 4-8. Particularly, FIG. 4 illustrates a first cover member 92 according to an aspect of the present disclosure, with FIG. 5 being in an exploded view having a first cover member 92 and a second cover member 94 that are spaced-apart from one another and configured to couple to a thermal bridge 96 having side members 96A-96D. An evacuation port 98 is shown disposed on the thermal bridge 96, but may be disposed on any part of the vacuum insulated structure 90 for accessing a cavity 100 (FIG. 7). As shown in FIGS. 4 and 5, the first and second cover members 92, 94 may include opposing outer walls (58 and 60) of the exterior wrapper 18 and/or one outer wall and corresponding portions of the upper and lower liners 20A, 20B, which are also spaced-apart from one another to define the insulating cavity 24 disposed therebetween as shown in FIG. 1A. Accordingly, the depicted thermal bridge 96 is to be understood as illustrative only such that in the application of a refrigerator outer wrapper 18, the thermal bridge 22 may be represented by side wall 96A only, with the above-described openings 25 and 26 being defined therein for receipt of the respective liners. In such an application, the remaining side walls 96B-96D may correspond with the top, bottom, and rear walls 58,60,62 of the wrapper 18.

The first cover member 92 includes an outer frame 102 disposed inwardly of the perimeter 104 of the first cover member 92 with the outer frame 102 surrounding an inner area 106. As discussed above, and as best shown in FIGS. 7 and 8, the inner area 106 defines a first planar level P1 with a portion of the outer frame portion 102 extending to a second planar level P2 parallel to and spaced apart from the first planar level in an axial direction A. As further shown, the outer frame portion 102 includes a first side wall 102A extending from the first planar level P1 to the second planar level P2, a face wall 102B extending inwardly in the radial direction R along the second planar level P2, and a second side wall 102C extending from the second planar level P2 to join with the inner area at the first planar level P1. The perimeter portion 104 is also shown as being disposed at the first planar level P1. In this manner, the inner area 106 is generally suspended at the first planar level P1, including with respect to the perimeter portion 104, by the outer frame portion 102 when the first cover member 92 is in the depicted pre-assembly and pre-evacuation state. As further shown, the second cover member 94 may be similarly formed with comparable structure and elements such that, in one aspect, the second cover member 94 may be a mirror image of the first cover member 92.

The first and second cover members 92, 94 are contemplated to be sheet metal cover members, wherein the outer frame portions 102 are stamped portions formed by a stamping process which stretches and thins specific portions around the outer frame portions 102. With specific reference to first cover member 92, weakened portions 93A and 93B are shown disposed around outer frame portions 102 and are contemplated to be weakened portions of the first cover member 92 having been stretched and thinned during a stamping process. In the illustrative schematic assembly 90, the first cover member 92 couples to a first surface 97 of thermal bridge 96, while second cover member 94 couples to a second surface 99 of the thermal bridge 96. By coupling the first cover member 92 and the second cover member 94 to the thermal bridge 96, a cavity for the vacuum insulated structure 90 is formed. The cavity is identified as reference numeral 100 as shown in FIGS. 5-8 and is contemplated to represent a portion of insulating cavity 24 of vacuum insulated cabinet structure 12 shown in FIG. 1A.

Referring now to FIG. 6, the vacuum insulated structure 90 is shown in an assembled condition as compared to the exploded view shown in FIG. 5. While the vacuum insulated structure 90 shown in FIG. 6 is provided in an at-rest or pre-evacuation stage, the structure 90 is still referred to herein as a vacuum insulated structure. In the assembled condition, the vacuum insulated structure 90 is shown having the first and second cover members 92, 94 coupled to the first and second surfaces 97, 99 (FIG. 5) of the thermal bridge 96. In this configuration, the inner areas 106 of the first and second cover members 92 and 94 remain disposed at the respective first planar levels P1. In the assembled condition shown in FIG. 6, the vacuum insulated structure 90 includes a cavity 100 which is generally accessible via port 98 disposed in the thermal bridge 96. While the embodiment shown in FIG. 6 includes the port 98 disposed on the thermal bridge 96, it is contemplated that the port 98 can be disposed on any portion of the vacuum insulated structure 90, so long as the port provides access to the cavity 100. In assembling the vacuum insulated structure 90, the cavity 100 can be filled with an insulation medium, such as open celled foam or a microporous filler material which may optionally include particulate reflectors or opacifiers, such as aluminum, flake or carbon black, to reduce transmission of radiation energy through the vacuum insulated structure 90. The cavity 100 may also be filled with an insulating material in the form of a powder comprised of fumed silica, glass beads, processed rice husks, or any combination thereof. The insulating material is contemplated to have a conducting coefficient or thermal conductivity of at least 5 mW/mK, or lower, to ensure that the insulating properties of the vacuum insulated structure 90 are sound. This filler material or insulating material is identified in FIGS. 7 and 8 as reference numeral 102.

The assembled vacuum insulated structure 90 is then subjected to an evacuation process, wherein the cavity 100 has been accessed via port 98 to draw a vacuum from the cavity 100, thereby providing a low pressure environment within the cavity 100. The low pressure environment of the cavity 100 may include a reduced internal pressure of less than 10 mbar, but may include other pressure settings conditioned on a filler material used in the vacuum insulated structure 90, and also conditioned on the desired insulative value of the vacuum insulated structure 90.

Referring now to FIG. 7, a cross-sectional view of the vacuum insulated structure 90 of FIG. 6 is shown, wherein the outer frame portions 102 of the first and second cover members 92, 94 are shown in un-deformed conditions suspending the inner areas 106 of the respective cover members 92 and 94 at the illustrated first planar levels P1. The face walls 102A and 102C of the outer frame portions 102 are shown extending along the second planar levels P2. As a vacuum is drawn on the cavity 100 of the vacuum insulated structure 90, the first and second cover members 92, 94 are subject to inwardly directed forces F1, F2, respectively, which drive the first and second cover members 92, 94 towards one another. Due to the weakened condition of the weakened portions 93A, 93C, 95A, 95C, these portions of the first and second cover members 92, 94 are more susceptible to bending or deflection as compared to the other portions of the first and second cover members 92, 94. Thus, due to the inwardly directed forces F1, F2 caused by the vacuum drawn within the cavity 100, the outer frame portions 102 of the first and second cover members 92, 94 deform under such forces F1,F2, particularly along face wall 102B, which allows the inner area 106 to move away from the first and second planar levels P1 and P2 in an axially inward direction.

Figure 8:
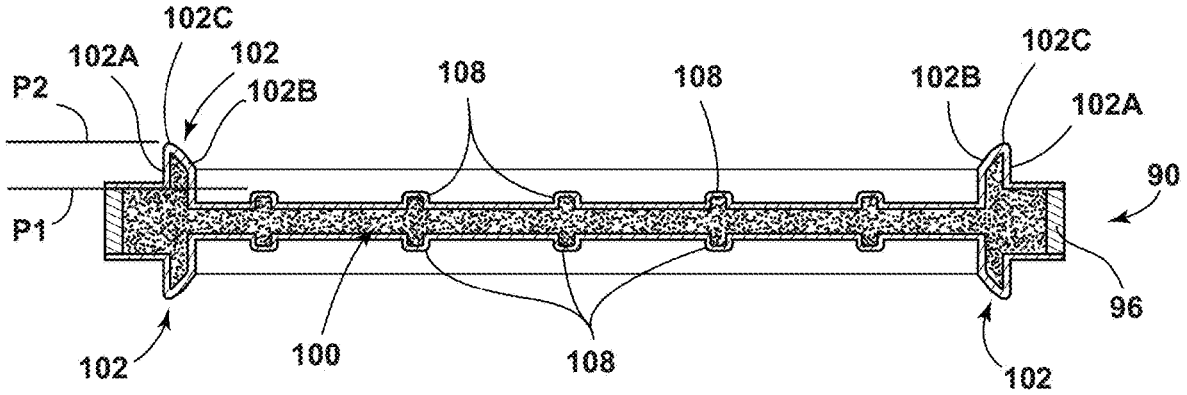
FIG. 8 is a cross-sectional view of the sidewall of the vacuum insulated cabinet structure of FIG. 7 after vacuum draw.
Figure 10A:
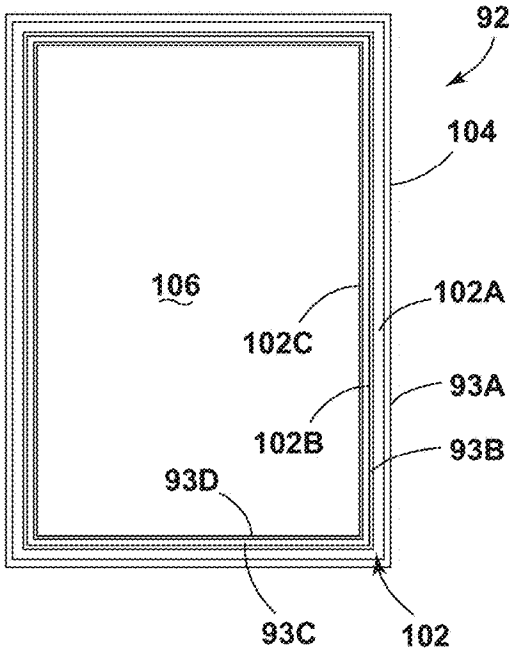
FIGS. 10A and 10B are side pan and cross-sectional views of an alternative cover member according to a further aspect of the disclosure.
Figure 10B:
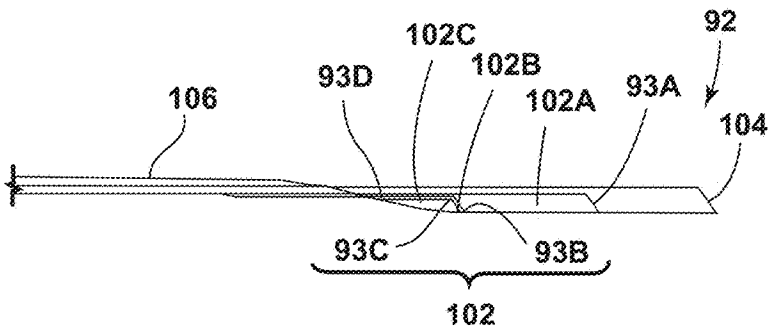

With reference to FIG. 8, the vacuum insulated structure 90 is shown after an evacuation procedure has been performed, such that the cavity 100 now represents an evacuated cavity. The outer frame portion 102 is shown as being deformed by axially inward flexing of the face wall 102B, particularly adjacent the second side wall 102C. In this manner, the face wall 102B is angled downwardly such that the second side wall 102C has moved with respect to the first side wall 102A along the axial direction A. This movement facilitates generally even inward movement of the inner area 106 relative to the first planar level P1, as depicted in FIG. 8. In this manner, the deformation of the first and second cover members 92 and 94 under the vacuum draw is localized to within the outer frame portions 102 such that the effects of such deformation are generally controlled. This may help maintain the desired performance of the vacuum insulated structure 90 while preserving the desired aesthetic quality thereof.

As further shown in FIGS. 4-8, the first and second cover members 92 and 94 include a plurality of ribs 108 arranged in a grid pattern and extending from the outer frame portions 102 across the inner area 106. The ribs 108 include a set of parallel ribs 108A extending in a first direction (i.e., horizontal in the image shown in FIG. 4) with a second set of parallel ribs 108B extending in a second direction perpendicular to the first direction (i.e., vertical in the image shown in FIG. 4) to define the above-described grid pattern. The sets of ribs 108A and 108B are also shown as stamped features within the sheet material of the first and second cover members 92 and 94. In this manner, they may be formed simultaneously with the outer frame portions 102. Additionally, the ribs 108 are shown intersecting with respective parallel ones of the second faces 102C of the outer frame portions 102. In this manner, the second faces 102C provide structural support for the ribs 108, with the ribs 108 being generally shorter than the second faces 102C such that the presence of ribs 108 does not interfere with the above-described inward deformation of the face wall 102B. The stamped nature of the ribs and the generalized grid pattern defined by the intersections of the respective sets of parallel ribs 108A and 108B provides structural support for the inner area 106 to resist deformation of the first and second cover members 92 and 94 within the inner areas 106. In this manner, the inner area moves inward in the axial direction A, as discussed above, under deformation of the outer frame 106, in a generally uniform manner, as shown in FIG. 8. Notably, some deformation of the inner area 106 may occur, including along the rectangular areas between intersecting ribs 108; however, such deformation may be less than 1 mm such that it is generally imperceptible to an observer, particularly when surrounded by the visual features of the first and second cover members 92 and 94, which may visually obscure such deformation. Additionally, the overall deformation shown in FIG. 8 may be schematically exaggerated, with the inward movement of the weakened portion 93C as well as the inward movement of the inner area 106 being less than 2 mm, and in one aspect between 1 mm and 2 mm.

Figure 9A:
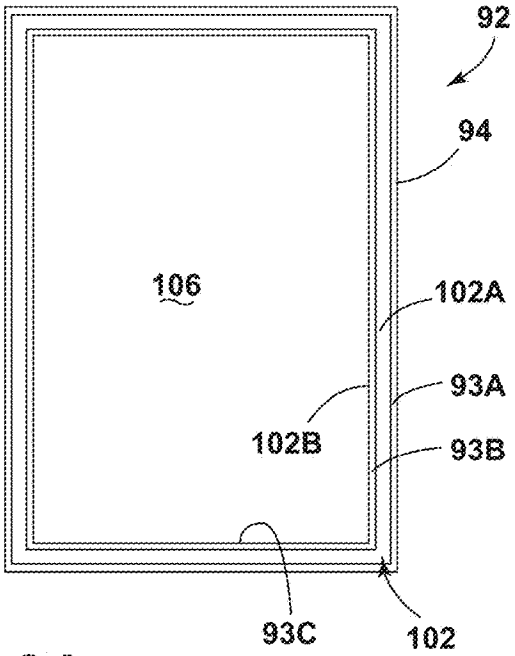
FIGS. 9A and 9B are side pan and cross-sectional views of an alternative cover member according to a further aspect of the disclosure.
Figure 9B:
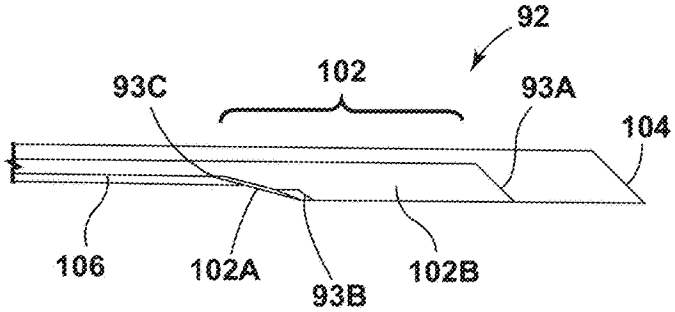
Figure 12A:
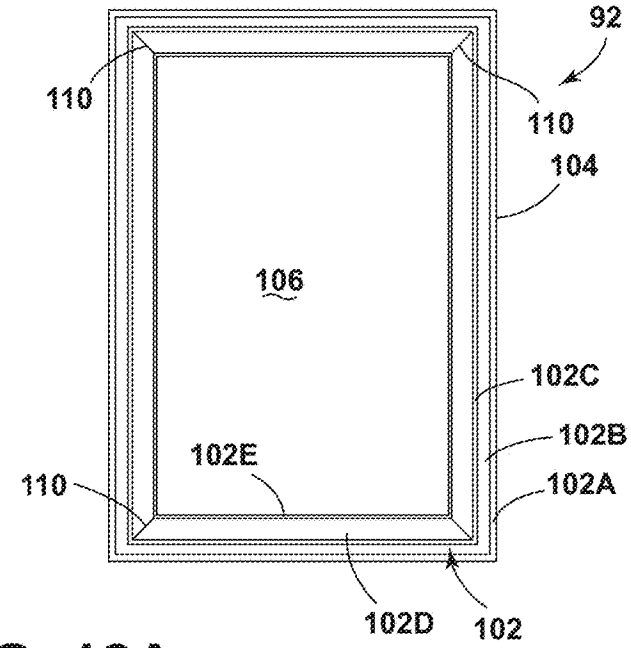
FIGS. 12A and 12B are side pan and cross-sectional views of an alternative cover member according to a further aspect of the disclosure.
Figure 12B:
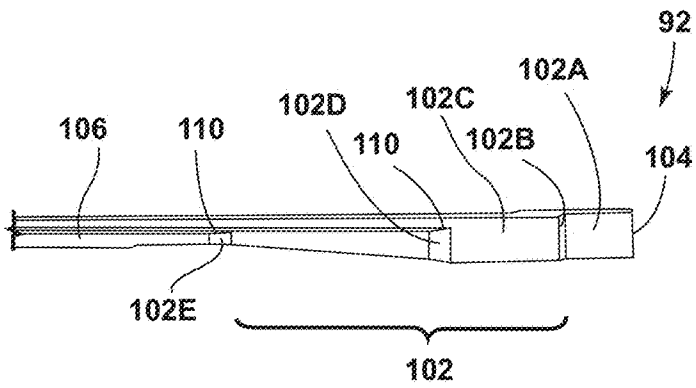
Figure 11A:
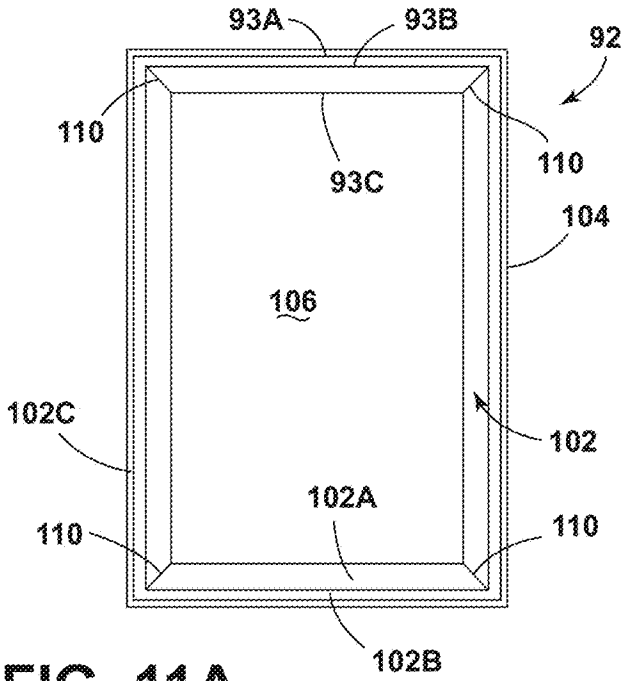
FIGS. 11A and 11B are side pan and cross-sectional views of an alternative cover member according to a further aspect of the disclosure.
Figure 11B:
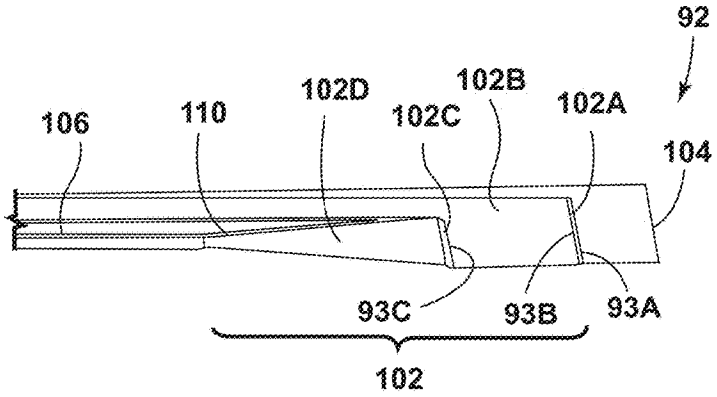
Figure 14A:
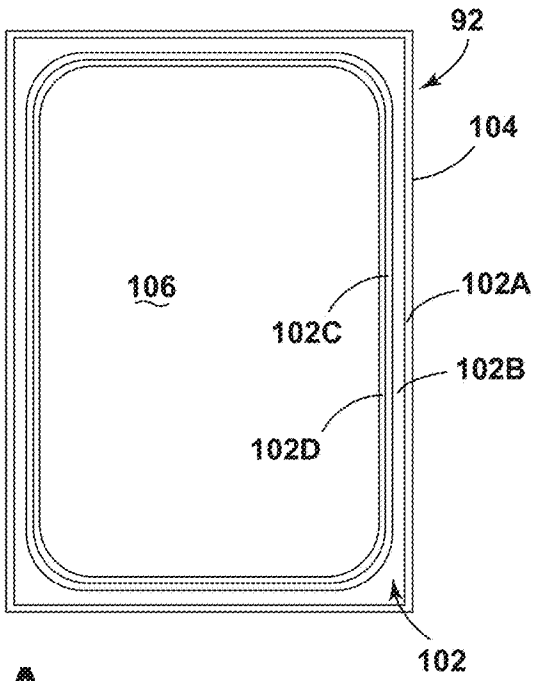
FIGS. 14A and 14B are side pan and cross-sectional views of an alternative cover member according to a further aspect of the disclosure.
Figure 14B:
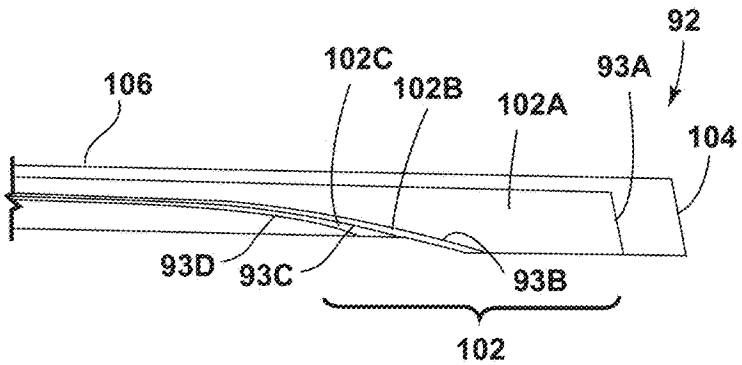
Figure 13A:
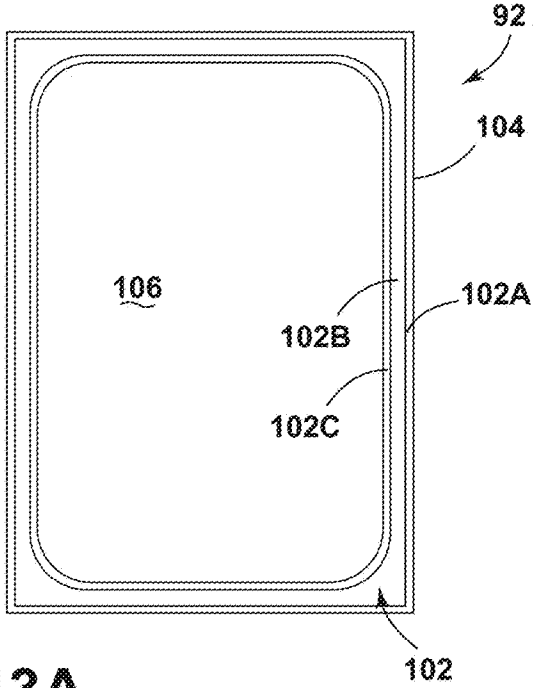
FIGS. 13A and 13B are side pan and cross-sectional views of an alternative cover member according to a further aspect of the disclosure.
Figure 13B:
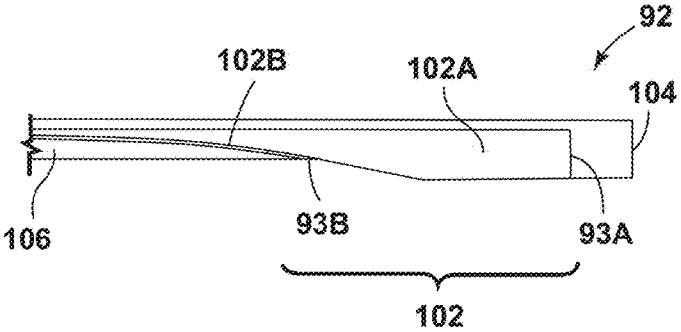
Figure 16A:
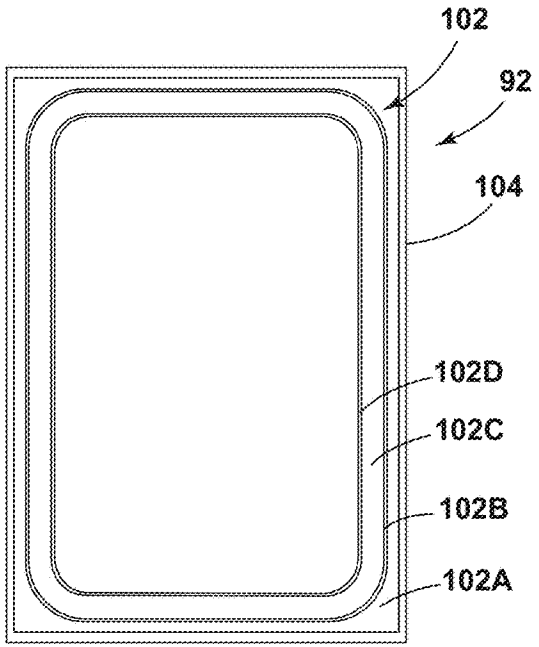
FIGS. 16A and 16B are side pan and cross-sectional views of an alternative cover member according to a further aspect of the disclosure.
Figure 16B:
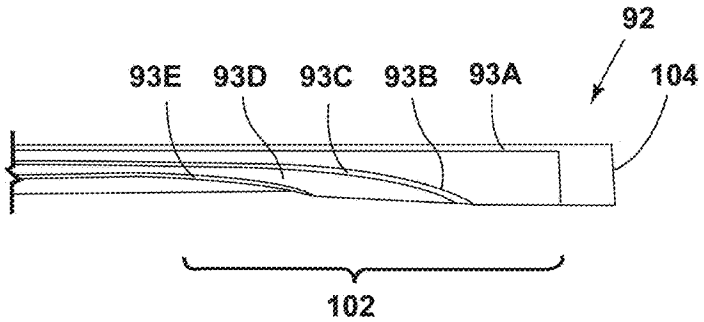
Figure 15A:
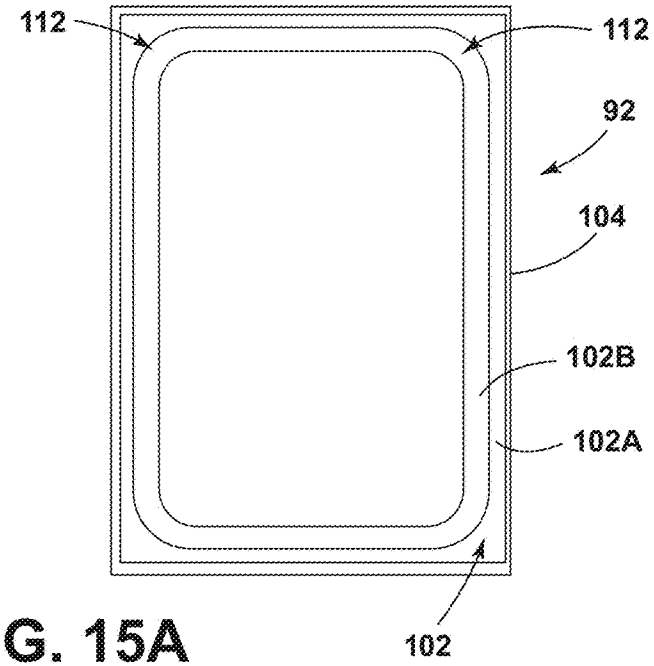
FIGS. 15A and 15B are side pan and cross-sectional views of an alternative cover member according to a further aspect of the disclosure.
Figure 15B:
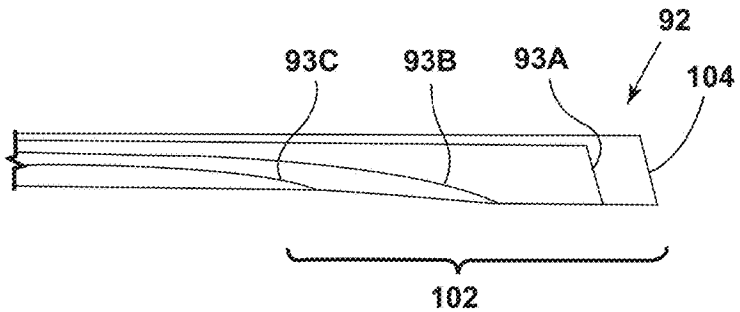

Referring now to FIGS. 9A-16B, a vacuum insulated structure 90A is shown according to another embodiment of the present concept. The vacuum insulated structure 90A includes many features similar to the vacuum insulated structure 90 shown in FIG. 4, for which like reference numerals will be used to represent similar features. The vacuum insulated structure 90A is also contemplated to represent a portion of the vacuum insulated cabinet structure 12 shown in FIG. 1A. Representation of the concept described in FIGS. 8-9B is also shown in FIGS. 21A and 21B with particular reference to a vacuum insulated cabinet structure 90B. As shown in the exploded view of FIG. 17, the vacuum insulated structure 90A includes first and second cover members 92, 94. The thermal bridge 96 includes side members 96A-96D, as well as evacuation port 98 for accessing a cavity 100 formed when the first and second cover members 92, 94 are coupled to the thermal bridge 96 at first and second surfaces 97, 99 of the thermal bridge 96. As discussed above with respect to the vacuum insulated structure of FIGS. 4 and 5, the first and second cover members 92, 94 may include opposing outer walls (58 and 60) of the exterior wrapper 18 and/or one outer wall and corresponding portions of the upper and lower liners 20A, 20B, which are also spaced-apart from one another to define an insulating cavity 24 disposed therebetween as shown in FIG. 1A. Accordingly, the depicted thermal bridge 96 is, again, to be understood as illustrative only such that in the application of a refrigerator outer wrapper 18, the thermal bridge 22 may be represented by side wall 96A only, with the above-described openings 25 and 26 being defined therein for receipt of the respective liners. In such an application, the remaining side walls 96B-96D may correspond with the top, bottom, and rear walls 58,60,62 of the wrapper 18.

FIGS. 9A-16B show various examples of the first cover member 92 according to the present embodiment. As shown, the first cover member 92 of each example includes an outer frame portion 102 disposed inwardly of the perimeter 104 of the first cover member 92 with the outer frame 102 surrounding an inner area 106. As best shown in one example in FIG. 9B, the inner area 106 defines a first planar level P1 with a portion of the outer frame portion 102 extending to a second planar level P2 parallel to and spaced apart from the first planar level in the axial direction A. As further shown, the outer frame portion 102 includes a first stepped segment 102A extending from the first planar level P1 to a second stepped segment 102B that extends to the second planar level P2, with both stepped segments 102A and 102B being angled to also extend outwardly in the radial direction R from the inner area 106 to the perimeter 104, the perimeter portion being disposed at the second planar level P2. In this manner, the inner area 106 is generally suspended outwardly from the perimeter 104 at the first planar level P1, including with respect to the perimeter portion 104, by the outer frame portion 102 when first cover member 92 is in the depicted pre-assembly and pre-evacuation state. In any assembly using the various depicted first cover member 92, the second cover member 94 may be similarly formed with comparable structure and elements such that, in one aspect, the second cover member 94 may be a mirror image of the first cover member 92.

The first and second cover members 92, 94 are contemplated to be sheet metal cover members, wherein the outer frame portions 102 are stamped portions formed by a stamping process which stretches and thins specific portions around the outer frame portions 102. With specific reference to the first cover member 92, weakened portions 93A, 93B, and 93C are shown disposed between the inner area 106 and the first stepped segment 102A, between the first and second stepped segments 102A, 102B, and around the second stepped segment 102B and are contemplated to be weakened portions of the first cover member 92 having been stretched and thinned during a stamping process. As can be appreciated, the various additional cover members illustrated in FIGS. 10A-16B vary in the number and configuration of stepped segments 102A, 102B, . . . 102X, as well as the number of corresponding weakened portions 93A, 93B, . . . 93X ,with, for example, the arrangement shown in FIGS. 10A and 10B having an additional stepped segment 102C outward of the second stepped segment 102B with a corresponding additional weakened portion 93D outward of the weakened portion 93C between the second and third stepped segments 102B, 102C. Additionally, the depicted first cover member 92 may vary in the corner transitions between horizontally- and vertically-extending portions of the outer frame portion 102. In particular, the variation of FIGS. 11A and 11B, as well as the further variation of FIGS. 12A and 12B that include beveled corner segments 110 that may serve to reinforce the stepped portion 102A (FIG. 11A) or 102B (FIG. 12A) through which they extend. In the alternative variation of FIGS. 13A-16B, the outer frame portions 102 are shown having rounded corners 112. It can be appreciated that any of the additional variations depicted in the referenced figures can be substituted in the assembly of FIGS. 17-20 to achieve a similar effect to that which is illustrated therein and described below.

In the illustrative schematic assembly 90, the first cover member 92 couples to a first surface 97 of thermal bridge 96, while the second cover member 94 couples to a second surface 99 of the thermal bridge 96. By coupling the first cover member 92 and the second cover member 94 to the thermal bridge 96, a cavity for the vacuum insulated structure 90 is formed. The cavity is identified as reference numeral 100 as shown in FIGS. 5-8 and is contemplated to represent a portion of insulating cavity 24 of vacuum insulated cabinet structure 12 shown in FIG. 1A.

Figure 17:
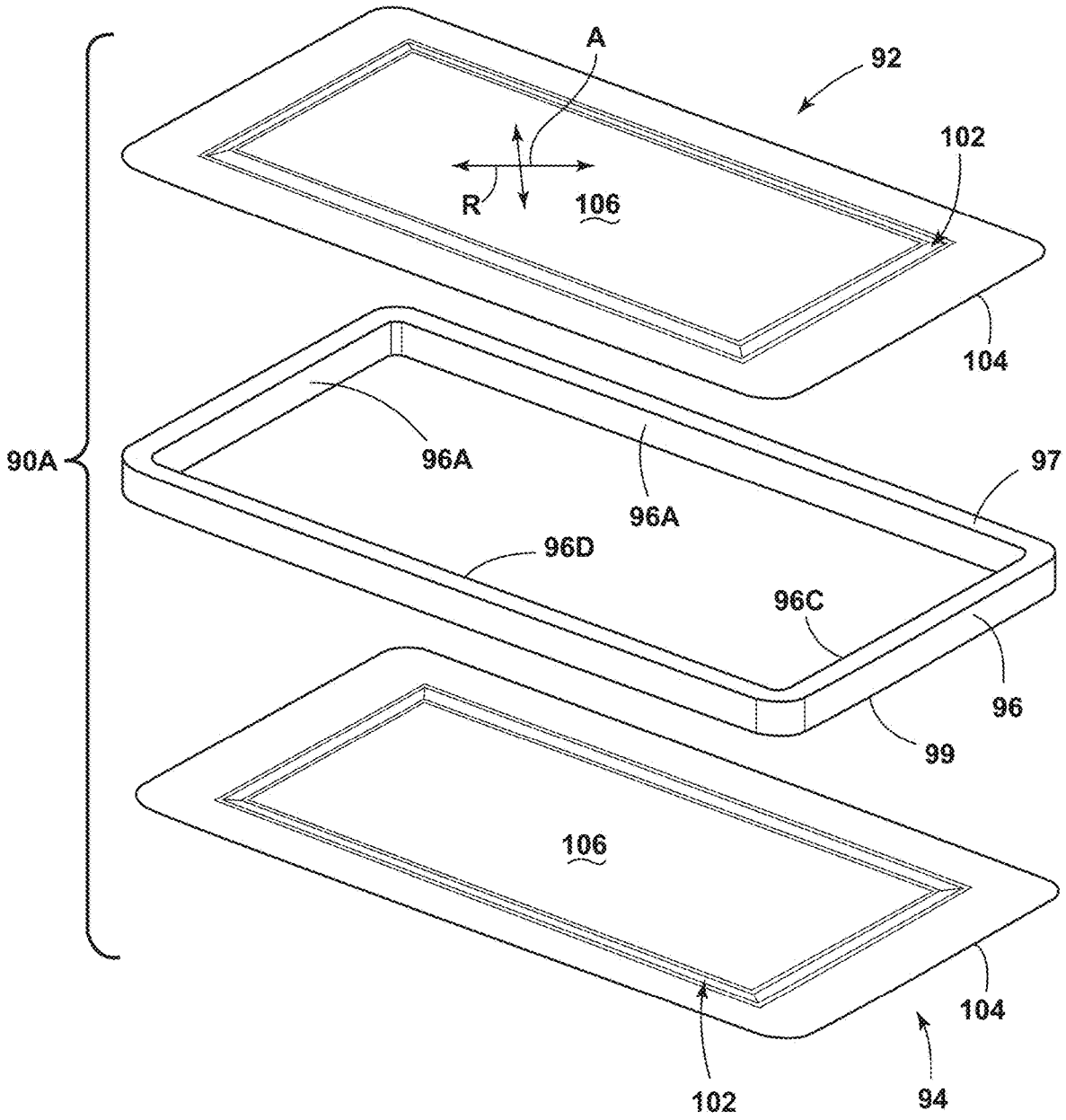
FIG. 17 is a an exploded top perspective view of a schematic vacuum insulated cabinet structure including the cover member of FIG. 10A.
Figure 18A:
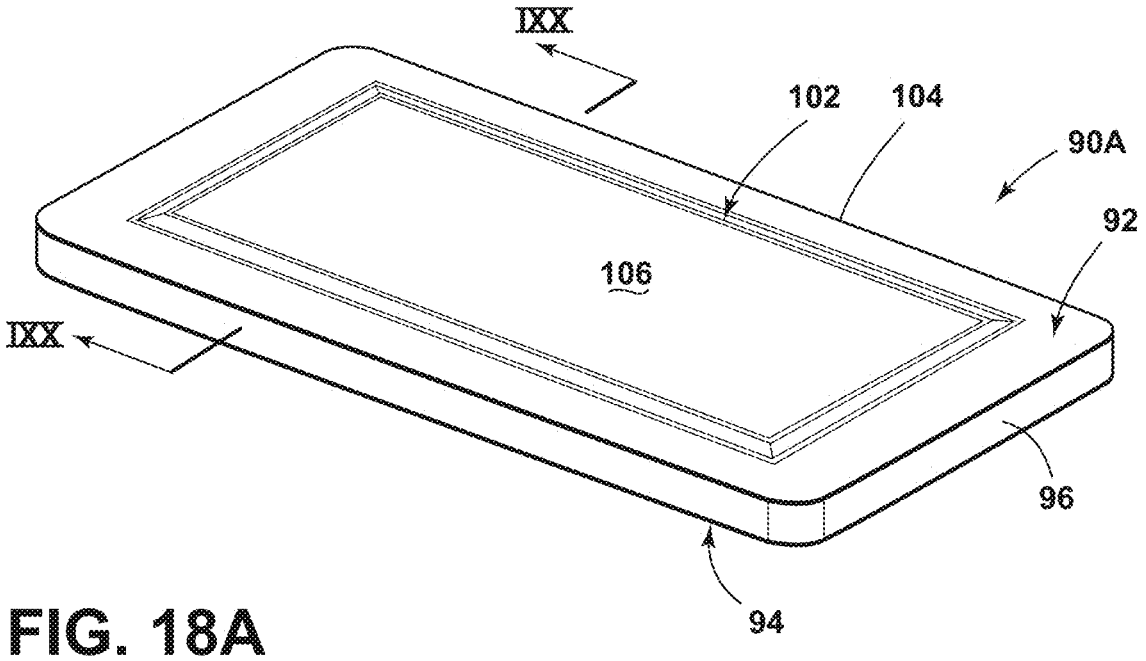
FIG. 18 is a top perspective view of the schematic vacuum insulated cabinet structure of FIG. 17 in an assembled condition and prior to a vacuum being drawn.
Figure 18B:
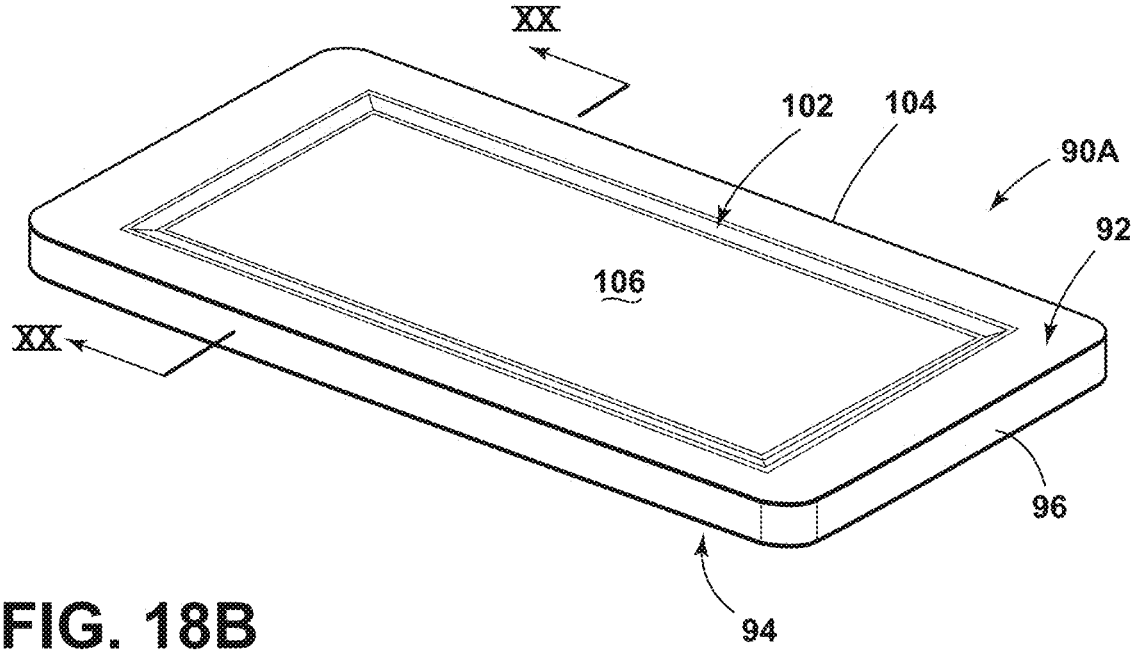

Referring now to FIG. 18A, the vacuum insulated structure 90 is shown in an assembled condition as compared to the exploded view shown in FIG. 17. While the vacuum insulated structure 90 shown in FIG. 18A is provided in an at-rest or pre-evacuation stage, the structure 90 is still referred to herein as a vacuum insulated structure. In the assembled condition, the vacuum insulated structure 90 is shown having the first and second cover members 92, 94 coupled to the first and second surfaces 97, 99 (FIG. 17) of the thermal bridge 96. In this configuration, the inner areas 106 of the first and second cover members 92 and 94 remain disposed at the respective first planar levels P1. In the assembled condition shown in FIG. 18, the vacuum insulated structure 90 includes a cavity 100 which is generally accessible via port 98 disposed in the thermal bridge 96 or elsewhere in the structure 90 for evacuating air from cavity 100, as discussed above with respect to FIGS. 6-8. In assembling the vacuum insulated structure 90, the cavity 100 can be filled with an insulation medium, as also discussed above. As shown in FIG. 18B, when the vacuum draw is implemented, the inner area 106 moves away from the first planar level P1 to a position disposed axially inward of the second planar level P2 by inversion of the outer frame 102, particularly within the stepped segments 102A, 102B, etc., as facilitated by the corresponding weakened portions 93A, 93B, etc.

Figure 19:
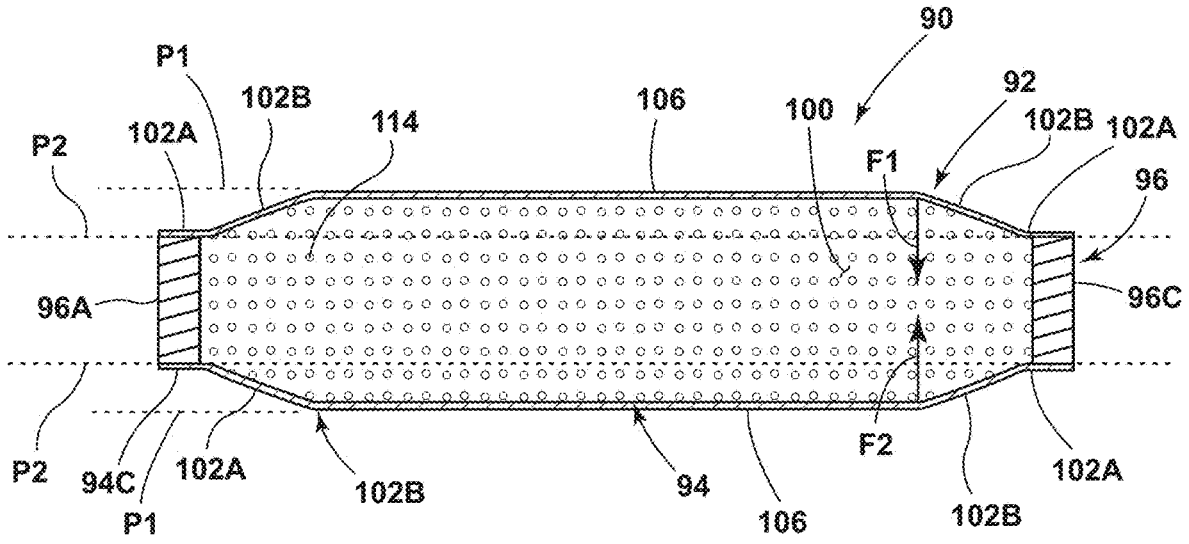
FIG. 19 is a cross-sectional view of the sidewall of the vacuum insulated cabinet structure of FIG. 18 taken at line XIX-XIX in FIG. 18.

Referring now to FIG. 19, a cross-sectional view of the vacuum insulated structure 90 of FIG. 18A is shown, wherein the outer frame portions 102 of the first and second cover members 92, 94 are shown in un-deformed conditions suspending the inner areas 106 of the respective first and second cover members 92 and 94 at the illustrated first planar levels P1. In this manner, the stepped segments 102A, 102B, are shown extending axially outward from the perimeter 104 (at the second planar level P2) to support the inner area 106 at the first planar level P1. As the vacuum is drawn on the cavity 100 of the vacuum insulated structure 90, the first and second cover members 92, 94 are subject to inwardly directed forces F1, F2, respectively, which drive the first and second cover members 92, 94 towards one another. Due to the weakened condition of the weakened portions 93A, 93B, etc., these portions of the first and second cover members 92, 94 are more susceptible to bending or deflection as compared to the other portions of the first and second cover members 92, 94. Thus, due to the inwardly directed forces F1, F2 caused by the vacuum drawn within the cavity 100, the outer frame portions 102 of the first and second cover members 92, 94 deform under such forces F1,F2, particularly along stepped segments 102A, 102B, which allows the inner area 106 to move away from the first planar level P1 and pass the second planar level in the axially inward direction.

Figure 20:
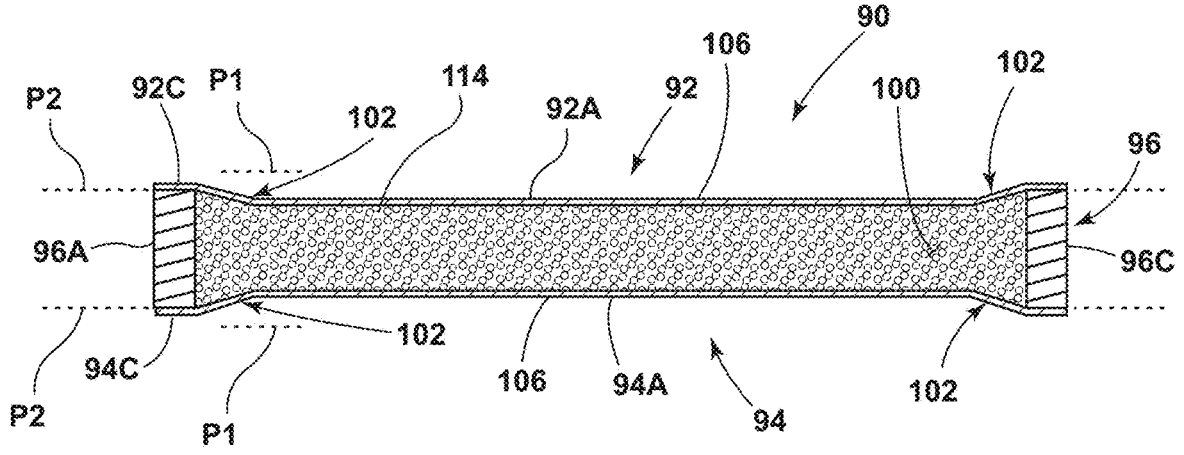
FIG. 20 is a cross-sectional view of the sidewall of the vacuum insulated cabinet structure of FIG. 19 after vacuum draw.

With reference to FIG. 20, the vacuum insulated structure 90 is shown after an evacuation procedure has been performed, such that the cavity 100 now represents an evacuated cavity. The outer frame portion 102 is shown as being deformed by axially inward flexing of the stepped segments 102A, 102B, at the corresponding weakened portions 93A, 93B, and 93C. In this manner, the outer frame 102 is inverted, which facilitates generally even inward movement of the inner area 106 relative to the first planar level P1, as depicted in FIG. 20. In this manner, the deformation of the first and second cover members 92 and 94 under the vacuum draw is localized to within the outer frame portions 102 such that the effects of such deformation are generally controlled. This may help maintain the desired performance of the vacuum insulated structure 90 while preserving the desired aesthetic quality thereof. The other depicted first cover members 92 from FIGS. 11A-16B would be understood as performing similarly under such conditions in such an assembly 90A.

Referring now to FIG. 21A, a vacuum insulated structure 90C is shown having exterior wrapper 18 and upper liner 20A interconnected by the thermal bridge 22 in a manner as found in FIGS. 18A and 18B described above. In the embodiment shown in FIG. 21A, the vacuum insulated structure 90C is shown having the sidewalls 58, 60 and rear wall 62 of the exterior wrapper 18 positioned in-line with second planar level P2. Similarly, the first and second sidewalls 34, 36 and rear wall 38 of the upper liner 20A are also shown positioned at a corresponding second planar level P2, such that the vacuum insulated structure 90C is configured in a pre-vacuum state. When the vacuum is drawn from the structure 90C, as shown in FIG. 21B, the inner areas 106 of each such panel inverts to the form shown in a similar manner to that which is described above in FIGS. 18A and 18B.

Another aspect of the present concept includes a method of making a vacuum insulated cabinet structure, such as cabinet structures 12 and 90C. The method includes the steps of: 1) assembling first and second cover members 92 and 94 with a thermal bridge 96, at least the first cover member 92 defining a perimeter portion 104, an outer frame portion 102 defined radially inward of the perimeter portion 104, and an inner area 106 surrounded and supported by the outer frame portion 102. The inner area 106 defines a first planar level P1 with a portion of the outer frame portion 102 extending to a second planar level P2 parallel to and spaced apart from the first planar level P1 in an axially outward direction. Assembling the first and second cover members 92 and 94 with the thermal bridge 96 defines a sealed insulating cavity 100 therebetween. The method further includes the step of: 2) drawing a vacuum from the sealed insulating cavity 100 that causes the outer frame portion 102 to deform such that the inner area 106 moves axially inward from the second planar level P2 under a force of the vacuum within the insulating cavity 100.

The invention disclosed herein is further summarized in the following paragraphs and is further characterized by combinations of any and all of the various aspects described therein.

According to another aspect of the present disclosure, a vacuum insulated structure a first cover member of a unitary sheet member defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axial direction. The vacuum insulated structure further includes a second cover member of a unitary sheet and a thermal bridge interconnecting the first cover member and the second cover member at the perimeter portions thereof to define an insulating cavity therebetween. The insulating cavity is a sealed cavity having a vacuum drawn therefrom, and the outer frame portion deforms such that the inner area moves axially inward away from the second planar level under a force of the vacuum within the insulating cavity.

The outer frame portion includes a first side wall extending from the first planar level to the second planar level, a face wall extending radially inwardly along the second planar level, and a second side wall extending from the second planar level to join with the inner area at the first planar level.

The outer frame portion deforms by axially inward flexing of the face wall adjacent the second side wall such that the second side wall moves with respect to the first side wall.

The perimeter portion is disposed at the second planar level.

The inner area is configured to resist deformation such that deformation of the first cover member is predominantly within the outer frame portion.

The inner area defines a plurality of ribs arranged in a grid pattern and extending from the outer frame across the inner area to provide structural support for the inner area to resist deformation.

The second cover member defines a perimeter portion, an outer frame portion defined radially inward of the perimeter portion, and an inner area surrounded and supported by the outer frame portion. The inner area defining a third planar level with a portion of the outer frame portion extending to a fourth planar level parallel to and spaced apart from the third planar level in an axially outward direction.

The outer frame portion of the second cover member deforms such that the inner area of the second cover member moves axially inward from the third and fourth planar levels under the force of the vacuum within the insulating cavity.

The vacuum insulated structure further includes an insulating material disposed within the insulating cavity.

The outer frame portion defines multiple stepped segments from the perimeter to the inner area and a plurality of beveled corner segments extending between the multiple stepped segments.

According to yet another aspect, a method of making a vacuum insulated cabinet structure includes assembling first and second cover members with a thermal bridge, at least the first cover member defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axially outward direction. Assembling the first and second cover members with the thermal bridge defines a sealed insulating cavity therebetween. The method further includes drawing a vacuum from the sealed insulating cavity that causes the outer frame portion to deform such that the inner area moves axially inward from the second planar level under a force of the vacuum within the insulating cavity.

The first cover member is a wrapper structure defining an exterior of the cabinet structure, and the second cover member is a liner structure defining an interior of the cabinet structure.

The first cover member defines a first exterior side on which the perimeter portion, the outer frame portion, and the inner area are defined, and the first cover member defines a second exterior side further defining an additional respective perimeter portion, outer frame portion, and inner area.

The outer frame portion includes a first side wall extending from the first planar level to the second planar level, a face wall extending radially inwardly along the second planar level, and a second side wall extending from the second planar level to join with the inner area at the first planar level, and drawing the vacuum from the sealed insulating cavity causes the outer frame portion to deform by axially inward flexing of the face wall adjacent the second side wall such that the second side wall moves with respect to the first side wall.

The inner area is configured to resist deformation such that drawing the vacuum from the sealed insulating cavity causes deformation of the first cover member predominantly within the outer frame portion.

The inner area defines a plurality of ribs arranged in a grid pattern and extending from the outer frame across the inner area to provide structural support for the inner area to resist deformation.

The method further includes introducing an insulation material into the insulting cavity.

The insulation material includes one of fumed silica, glass beads, processed rice husks, and a combination thereof.

According to yet another aspect, a refrigerator includes a vacuum-insulated cabinet structure having an outer wrapper with a first side defining a perimeter portion, an outer frame portion defined radially inward of the perimeter portion, and an inner area surrounded and supported by the outer frame portion. The inner area defines a first planar level with a portion of the outer frame portion extending to a second planar level parallel to and spaced apart from the first planar level in an axially outward direction. The refrigerator further includes an inner liner disposed inward of the outer wrapper and a thermal bridge interconnecting the first cover member and the second cover member at the perimeter portions thereof to define an insulating cavity therebetween. The insulating cavity is a sealed cavity having a vacuum drawn therefrom, and the outer frame portion deforms such that the inner area moves axially inward away from the second planar level under a force of the vacuum within the insulating cavity.

The thermal bridge surrounds an opening to an inner cavity of the refrigerator defined by the inner liner, and the refrigerator further includes at least one door operably closing the opening.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator, comprising:

a vacuum-insulated cabinet structure enclosing an insulating cavity and including an outer wrapper having a first side wall defining:

a perimeter;

an outer frame portion defined radially inward of the perimeter; and an inner area surrounded and supported by the outer frame portion, the inner area initially defining a first planar level with at least a portion of the outer frame portion extending to a second planar level parallel to and spaced apart from the first planar level in an axially outward direction, the insulating cavity being sealed and having a vacuum drawn therefrom with the outer frame portion deformed such that the inner area is moved axially inward away from the second planar level under a force of the vacuum within the insulating cavity with at least the portion of the outer frame portion remaining at the second planar level.

2. The refrigerator of claim 1, wherein the vacuum-insulated cabinet structure further defines:

an interior cavity within and at least partially enclosed by the insulating cavity; and an opening to the interior cavity.

3. The refrigerator of claim 2, further including a door closeable over at least a portion of the opening.

4. The refrigerator of claim 2, wherein the vacuum-insulated cabinet structure further includes:

an inner liner disposed inward of the outer wrapper and defining the inner cavity; and a thermal bridge interconnecting the outer wrapper and the inner liner around the opening.

5. The refrigerator of claim 1, wherein the outer wrapper further has a second side, defining:

a perimeter;

an outer frame portion defined radially inward of the perimeter; and an inner area surrounded and supported by the outer frame portion, the inner area initially defining a first planar level with at least a portion of the outer frame portion extending to a second planar level parallel to and spaced apart from the first planar level in an axially outward direction, the outer frame portion being deformed from the vacuum drawn the insulating cavity such that the inner area is moved axially inward away from the second planar level under a force of the vacuum within the insulating cavity with at least the portion of the outer frame portion remaining at the second planar level.

6. The refrigerator of claim 5, wherein the first and second side walls are defined on opposite lateral sides of the refrigerator.

7. The refrigerator of claim 1, wherein the outer frame portion of the first side wall includes a first side wall extending from the first planar level to the second planar level in a direction perpendicular to the first planar level, a face wall extending radially inwardly along the second planar level, and a second side wall extending from the second planar level to join with the inner area at the first planar level.

8. The refrigerator of claim 7, wherein the outer frame portion of the first side wall deforms by axially inward flexing of the face wall adjacent the second side wall such that the second side wall moves inward with respect to the first side wall opposite the direction perpendicular to the first planar level.

9. The refrigerator of claim 7, wherein the perimeter of the outer frame portion extends outward from the first side wall of the outer frame portion and disposed at the first planar level.

10. The refrigerator of claim 1, wherein the inner area of the first side wall is configured to resist deformation when moved axially inward such that deformation of the first cover member is predominantly within the outer frame portion.

11. The refrigerator of claim 10, wherein the inner area of the first side wall defines a plurality of ribs arranged in a grid pattern and extending from the outer frame across the inner area to provide structural support for the inner area to resist deformation.

12. The refrigerator of claim 1, further including an insulating material disposed within the insulating cavity.

13. The refrigerator of claim 1, wherein the outer frame portion of the first side wall defines multiple stepped segments from the perimeter to the inner area and a plurality of beveled corner segments extending between the multiple stepped segments.

14. A refrigerator, comprising:

a cabinet enclosing an insulating cavity and including:

an outer wrapper having a first side wall defining:

a perimeter;

an outer frame portion defined radially inward of the perimeter; and an inner area surrounded and supported by the outer frame portion, the inner area initially defining a first planar level with at least a portion of the outer frame portion extending to a second planar level parallel to and spaced apart from the first planar level in an axially outward direction, the insulating cavity being sealed and having a vacuum drawn therefrom with the outer frame portion deformed such that the inner area is moved axially inward away from the second planar level under a force of the vacuum within the insulating cavity with at least the portion of the outer frame portion remaining at the second planar level;

a first inner liner disposed inward of the outer wrapper and defining a first inner cavity having a first opening; and a thermal bridge interconnecting the outer wrapper and the first inner liner around the first opening; and a first door closeable over at least a portion of the first opening.

15. The refrigerator of claim 14, wherein:

the cabinet further includes a second inner liner disposed inward of the outer wrapper, positioned adjacent the first liner and defining a second inner cavity having a first opening; and the thermal bridge further interconnects the outer wrapper and the second inner liner around the second opening.

16. The refrigerator of claim 15, further including a second door closeable over at least a portion of the second opening.

17. The refrigerator of claim 14, wherein:

the first interior cavity is a fresh food cavity; and the second interior cavity is a freezer cavity.

18. The refrigerator of claim 14, wherein the outer wrapper further has a second side, defining:

a perimeter;

an outer frame portion defined radially inward of the perimeter; and an inner area surrounded and supported by the outer frame portion, the inner area initially defining a first planar level with at least a portion of the outer frame portion extending to a second planar level parallel to and spaced apart from the first planar level in an axially outward direction, the outer frame portion being deformed from the vacuum drawn the insulating cavity such that the inner area is moved axially inward away from the second planar level under a force of the vacuum within the insulating cavity with at least the portion of the outer frame portion remaining at the second planar level.

19. The refrigerator of claim 14, wherein the inner area of the first side wall is configured to resist deformation when moved axially inward such that deformation of the first cover member is predominantly within the outer frame portion.

20. A method of making refrigerator comprising:

sealing an outer wrapper having a first side wall to a first inner liner to define a vacuum-insulated cabinet structure enclosing an insulating cavity and including an outer wrapper, the first side wall defining:

a perimeter;

an outer frame portion defined radially inward of the perimeter; and an inner area surrounded and supported by the outer frame portion, the inner area initially defining a first planar level with at least a portion of the outer frame portion extending to a second planar level parallel to and spaced apart from the first planar level in an axially outward direction; and drawing a vacuum from the insulating cavity such that the outer frame portion deforms by movement of the inner area axially inward away from the second planar level with at least the portion of the outer frame portion remaining at the second planar level.

* * * * *